US008816917B2

(12) United States Patent
Ueno et al.

(10) Patent No.: US 8,816,917 B2
(45) Date of Patent: Aug. 26, 2014

(54) ANTENNA DEVICE

(75) Inventors: Mikio Ueno, Tokyo (JP); Ryuichi Taira, Tokyo (JP); Shin Matsumoto, Tokyo (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 13/979,371

(22) PCT Filed: Jan. 12, 2012

(86) PCT No.: PCT/JP2012/050527

§ 371 (c)(1),
(2), (4) Date: Sep. 10, 2013

(87) PCT Pub. No.: WO2012/096355

PCT Pub. Date: Jul. 19, 2012

(65) Prior Publication Data

US 2013/0342405 A1 Dec. 26, 2013

(30) Foreign Application Priority Data

Jan. 12, 2011 (JP) ..... 2011-004231

(51) Int. Cl.

| | |
|---|---|
| ***H01Q 1/32*** | (2006.01) |
| ***H01Q 1/36*** | (2006.01) |
| ***H01Q 5/00*** | (2006.01) |
| ***H01Q 11/08*** | (2006.01) |

(52) U.S. Cl.

CPC ..... *H01Q 1/32* (2013.01); *H01Q 5/0062* (2013.01); *H01Q 11/08* (2013.01); *H01Q 1/3275* (2013.01)

USPC ..... 343/713; 343/895

(58) Field of Classification Search

CPC ..... H01Q 1/3275; H01Q 1/32; H01Q 11/08; H01Q 5/0062

USPC ..... 343/713, 895

See application file for complete search history.

(56) References Cited

U.S. PATENT DOCUMENTS

| | | | |
|---|---|---|---|
| 3,659,678 | A | 5/1972 | Hall, Jr. |
| 4,490,003 | A | 12/1984 | Robinson |
| 4,563,659 | A | 1/1986 | Sakamoto |
| 4,781,623 | A | 11/1988 | Philippson et al. |
| 5,195,014 | A | 3/1993 | Krantz, Jr. et al. |
| 5,198,958 | A | 3/1993 | Krantz, Jr. et al. |
| 5,363,114 | A | 11/1994 | Shoemaker |
| 5,525,071 | A | 6/1996 | Obara et al. |
| 5,565,877 | A | 10/1996 | Du et al. |
| 5,668,559 | A | 9/1997 | Baro |
| 5,732,440 | A | 3/1998 | Wright |

(Continued)

FOREIGN PATENT DOCUMENTS

| | | |
|---|---|---|
| CN | 201041825 | 3/2008 |
| CN | 101479878 | 7/2009 |

(Continued)

*Primary Examiner* — Hoang V Nguyen
(74) *Attorney, Agent, or Firm* — Wells St. John P.S.

(57) ABSTRACT

A low profile antenna device for use in a vehicle comprises a base unit, and an antenna unit. The antenna unit is supported on the base unit, and is provided with a first helical unit on the side near to the base unit, and a second helical unit on the side far from the base unit. The second helical unit is configured such that the surface area is larger per unit length than that of the first helical unit.

14 Claims, 31 Drawing Sheets

(56) References Cited

U.S. PATENT DOCUMENTS

| | | | | |
|---|---|---|---|---|
| 5,757,327 | A | 5/1998 | Yajima et al. | |
| 5,797,771 | A | 8/1998 | Garside | |
| 5,995,064 | A | 11/1999 | Yanagisawa et al. | |
| 6,175,080 | B1 | 1/2001 | Nigthingale | |
| 6,177,911 | B1 | 1/2001 | Yuda et al. | |
| 6,310,586 | B1 | 10/2001 | Takahashi et al. | |
| 6,486,842 | B2 | 11/2002 | Wang | |
| 6,747,603 | B1 | 6/2004 | Tornatta et al. | |
| 6,879,301 | B2 | 4/2005 | Kozlovski | |
| 6,940,366 | B2 | 9/2005 | Komiya | |
| 7,019,701 | B2 | 3/2006 | Ohno et al. | |
| 7,037,144 | B2 | 5/2006 | Wang et al. | |
| 7,148,850 | B2 | 12/2006 | Puente Baliarda et al. | |
| 7,156,678 | B2 | 1/2007 | Feldman et al. | |
| 7,164,386 | B2 | 1/2007 | Baliarda et al. | |
| 7,170,459 | B1 | 1/2007 | McKim | |
| 7,202,822 | B2 | 4/2007 | Baliarda et al. | |
| 7,210,965 | B1 | 5/2007 | Zhong et al. | |
| 7,271,773 | B2 | 9/2007 | Gorai et al. | |
| 7,312,761 | B2 | 12/2007 | Gorai et al. | |
| 7,394,438 | B2 | 7/2008 | Forster et al. | |
| 7,414,588 | B2 | 8/2008 | Tateno | |
| 7,420,517 | B2 | 9/2008 | Oshima et al. | |
| 7,554,490 | B2 | 6/2009 | Baliarda et al. | |
| 7,579,998 | B1 | 8/2009 | Fang et al. | |
| 7,598,913 | B2 | 10/2009 | Rao et al. | |
| 7,671,504 | B2 | 3/2010 | Rohrer et al. | |
| 7,845,983 | B2 | 12/2010 | Kawada et al. | |
| 7,868,834 | B2 | 1/2011 | Ortigosa et al. | |
| 7,928,913 | B2 | 4/2011 | Kaneda et al. | |
| 7,952,533 | B2 | 5/2011 | Hur et al. | |
| 7,961,065 | B2 | 6/2011 | Kobayashi et al. | |
| 8,207,893 | B2 | 6/2012 | Baliarda et al. | |
| 8,212,726 | B2 | 7/2012 | Baliarda et al. | |
| 8,471,772 | B2 | 6/2013 | Puente Baliarda et al. | |
| 8,497,807 | B2 | 7/2013 | Wakui et al. | |
| 8,502,742 | B2 | 8/2013 | Wakui et al. | |
| 8,605,002 | B2 * | 12/2013 | Nishi et al. | 343/873 |
| 2001/0022716 | A1 | 9/2001 | Glaser et al. | |
| 2001/0050649 | A1 | 12/2001 | Wang | |
| 2002/0050873 | A1 | 5/2002 | Tsunoda et al. | |
| 2002/0080088 | A1 | 6/2002 | Boyle | |
| 2003/0058186 | A1 | 3/2003 | Saito et al. | |
| 2003/0112191 | A1 | 6/2003 | Maeda et al. | |
| 2003/0228806 | A1 | 12/2003 | Wang et al. | |
| 2004/0090366 | A1 | 5/2004 | Wong et al. | |
| 2004/0119644 | A1 | 6/2004 | Puente-Baliarda et al. | |
| 2004/0233108 | A1 | 11/2004 | Bordi | |
| 2005/0195112 | A1 | 9/2005 | Baliarda et al. | |
| 2005/0200530 | A1 | 9/2005 | Aikawa et al. | |
| 2005/0231427 | A1 | 10/2005 | Baliarda et al. | |
| 2005/0264453 | A1 | 12/2005 | Baliarda et al. | |
| 2006/0040562 | A1 | 2/2006 | Funatsu | |
| 2006/0097937 | A1 | 5/2006 | Gorai et al. | |
| 2006/0187131 | A1 | 8/2006 | Oshima | |
| 2006/0232488 | A1 | 10/2006 | Wang et al. | |
| 2006/0274472 | A1 | 12/2006 | Saito et al. | |
| 2006/0290587 | A1 | 12/2006 | Forster et al. | |
| 2007/0152886 | A1 | 7/2007 | Baliarda et al. | |
| 2007/0279302 | A1 | 12/2007 | Byrne et al. | |
| 2008/0117111 | A1 | 5/2008 | Ikeda et al. | |
| 2008/0198082 | A1 | 8/2008 | Soler Castany et al. | |
| 2009/0109101 | A1 | 4/2009 | Baliarda et al. | |
| 2009/0115551 | A1 | 5/2009 | Kobayashi et al. | |
| 2009/0140927 | A1 | 6/2009 | Maeda et al. | |
| 2009/0153404 | A1 | 6/2009 | Ryou et al. | |
| 2009/0156059 | A1 | 6/2009 | Zhu et al. | |
| 2009/0207084 | A1 | 8/2009 | Ikeda et al. | |
| 2009/0237313 | A1 | 9/2009 | Martinez Ortigosa | |
| 2009/0267847 | A1 | 10/2009 | Sato et al. | |
| 2009/0280688 | A1 | 11/2009 | Kawada et al. | |
| 2009/0284441 | A1 | 11/2009 | Wakui et al. | |
| 2009/0295645 | A1 | 12/2009 | Campero et al. | |
| 2009/0303134 | A1 | 12/2009 | Baliarda et al. | |
| 2010/0007566 | A1 | 1/2010 | Kobayashi et al. | |
| 2010/0009565 | A1 | 1/2010 | Wang | |
| 2010/0245189 | A1 | 9/2010 | Wang | |
| 2010/0265145 | A1 * | 10/2010 | Chung | 343/713 |
| 2010/0265147 | A1 | 10/2010 | Wakui et al. | |
| 2010/0277380 | A1 | 11/2010 | Breden et al. | |
| 2011/0074524 | A1 | 3/2011 | Nishioka | |
| 2011/0102269 | A1 | 5/2011 | Sato et al. | |
| 2011/0177839 | A1 | 7/2011 | Baliarda et al. | |
| 2011/0181478 | A1 | 7/2011 | Baliarda et al. | |
| 2011/0181481 | A1 | 7/2011 | Baliarda et al. | |
| 2011/0260934 | A1 | 10/2011 | Ilno et al. | |
| 2012/0326934 | A1 | 12/2012 | Wakui et al. | |
| 2013/0176180 | A1 | 7/2013 | Wakui et al. | |

FOREIGN PATENT DOCUMENTS

| | | |
|---|---|---|
| DE | 60105892 | 10/2005 |
| EP | 1162685 | 12/2001 |
| JP | 55-138913 | 10/1980 |
| JP | 59-078711 | 5/1984 |
| JP | 60-126963 | 8/1985 |
| JP | 2-32223 | 2/1990 |
| JP | 04-257111 | 9/1992 |
| JP | 05-058223 | 3/1993 |
| JP | H05-058223 | 3/1993 |
| JP | U1993 039009 | 5/1993 |
| JP | 05-191124 | 7/1993 |
| JP | 06-203897 | 7/1994 |
| JP | 7-36381 | 4/1995 |
| JP | 7-176929 | 7/1995 |
| JP | 7272942 | 10/1995 |
| JP | 9213528 | 8/1997 |
| JP | 09-232851 | 9/1997 |
| JP | 10-056315 | 2/1998 |
| JP | 11-040920 | 2/1999 |
| JP | 2000-353573 | 12/2000 |
| JP | 2001-127522 | 5/2001 |
| JP | 2001-291540 | 10/2001 |
| JP | 2001-345613 | 12/2001 |
| JP | 2002-359514 | 12/2002 |
| JP | 2003-521146 | 7/2003 |
| JP | 2003-264043 | 9/2003 |
| JP | 2004-031068 | 1/2004 |
| JP | 2004-082749 | 3/2004 |
| JP | 2004-153502 | 3/2004 |
| JP | 2004-159153 | 6/2004 |
| JP | 2004-516700 | 6/2004 |
| JP | 2005-102031 | 4/2005 |
| JP | 2005-110200 | 4/2005 |
| JP | 2006-033172 | 2/2006 |
| JP | 2006-059846 | 3/2006 |
| JP | 2006-108848 | 4/2006 |
| JP | 2006-121369 | 5/2006 |
| JP | 2006-166041 | 6/2006 |
| JP | 2006-178847 | 6/2006 |
| JP | 2006-186881 | 7/2006 |
| JP | 2007-036354 | 2/2007 |
| JP | 2007-072952 | 3/2007 |
| JP | 2007-124892 | 5/2007 |
| JP | 2008-035479 | 2/2008 |
| JP | 2008-523671 | 7/2008 |
| JP | 2009-290377 | 12/2009 |
| JP | 2010-021856 | 1/2010 |
| JP | 2011-035519 | 2/2011 |
| WO | WO 01/31736 | 5/2001 |
| WO | WO 2007/020902 | 2/2007 |
| WO | PCT/JP2007/000505 | 5/2007 |
| WO | WO 2008/001482 | 1/2008 |
| WO | WO 2008/062746 A1 | 5/2008 |
| WO | PCT/JP2010/058364 | 5/2010 |
| WO | PCT/JP2012/050527 | 9/2012 |

* cited by examiner

FIG. 6

| | Listener1 | | Listener2 | |
|---|---|---|---|---|
| kHz | Prior Art | Present Invention | Prior Art | Present Invention |
| 558 | 8 | 8 | 9 | 9 |
| 693 | 5 | 5 | 6 | 6 |
| 927 | 6 | 6 | 8 | 8 |
| 1107 | 5 | 5 | 3 | 3 |
| 1206 | 6 | 6 | 9 | 9 |
| 1431 | 7 | 8 | 9 | 9 |
| 1548 | 6.5 | 6.5 | 8 | 9 |
| AVG | 6.2 | 6.4 | 7.4 | 7.6 |

| Prior Art | Present Invention |
|---|---|
| 16 | 16 |

(a)

(b)

(a)

(b)

(a)

(b)

ANTENNA DEVICE

CROSS REFERENCE TO RELATED APPLICATION

This is a 35 U.S.C. §371 application of, and claims priority to, International Application No. PCT/JP2012/050527, which was filed on Jan. 12, 2012, which claims priority to Japanese Patent Application No. 2011-004231, which was filed on Jan. 12, 2011, the entirety of all the applications are incorporated herein by reference.

TECHNICAL FIELD

The present invention relates to an antenna device, and more particularly to a technique suitably applied to a low-profile vehicle-mounted antenna device capable of receiving AM broadcast and FM broadcast.

BACKGROUND ART

Various antenna devices are now available for vehicle mounted use. As such an antenna device, there is known, for example, an AM/FM radio antenna capable of receiving AM broadcast and FM broadcast. In general, as the AM/FM radio antenna, a rod antenna is used. The rod antenna is constituted by an element portion having an element (helical element) including a helical conductor covered by a cover and a base portion for attachment of the element portion.

In a state where the rod antenna is attached to a vehicle body, the element portion significantly protrudes from the vehicle body, which may impair an outer appearance and design of the vehicle, which may be broken at the time of parking or car washing, and which may be in danger of theft because the rod antenna is mounted outside the vehicle.

Under such circumstances, there is proposed a low-profile antenna device having a configuration in which the entire height of the antenna device is made lower than that of the rod antenna, the element is housed in an antenna case to prevent an element from being exposed outside, and the antenna case is formed into a shark-fin shape in consideration of design of the entire vehicle after attachment of the antenna. Many low-profile antenna devices having such a configuration have a height of 70 mm or lower and a longitudinal length of around 200 mm in terms of regulatory requirements.

However, the low-profile antenna device having a height as low as 70 mm or less may degrade radiation efficiency due to antenna conductor loss (reduction in element length), which may cause sensitivity degradation. For example, Patent Document 1 discloses an antenna device aiming to solve this problem. In the antenna device disclosed in Patent Document 1, an antenna substrate having an antenna pattern formed thereon and having a coil for antenna inductance correction between the antenna pattern and a feeding point is vertically arranged on a base portion, and a hat-shaped top portion is disposed at an upper end of the antenna substrate so as to straddle the antenna substrate.

CITATION LIST

Patent Document

Patent Document 1: Japanese Patent Application Kokai Publication No. 2010-21856

DISCLOSURE OF THE INVENTION

Problems to be Solved by the Invention

The antenna device disclosed in Patent Document 1 has two problems. One is lower antenna gain than the above existing rod antenna (having a height of 180 mm). The other is that the coil only performs inductance correction but does not function as an antenna and that the hat-shaped top part covers the antenna pattern, so that substantially only the top part functions as an antenna emitting radio waves, which degrades antenna efficiency.

In view of the above situation, an object of the present invention is to allow, in a low-profile antenna device having a limited space for the element, the entire element to function efficiently as an antenna in the limited space to improve antenna characteristics.

Means for Solving the Problems

To achieve the above object of the present invention, there is provided a low-profile antenna device for use in a vehicle comprising: a base portion fixed to the vehicle; and an antenna portion supported by the base portion and including a first helical portion disposed on a near side to the base portion and a second helical portion disposed on a far side from the base portion, the second helical portion having a larger surface area per unit length than that of the first helical portion.

The antenna portion may have a portion having a length in a longitudinal direction that passes perpendicularly through a helical axis larger than a length thereof in the helical axis direction.

The first helical portion may be adjusted to a resonance frequency of a higher band when the antenna portion is designed as a two-wave adaptive antenna.

The second helical portion may be disposed so as not to cover the first helical portion as viewed in a direction passing perpendicularly through a helical axis.

A horizontal width of the second helical portion as viewed in a short-side direction perpendicular to the helical axis direction may be equal to or smaller than a horizontal width of the first helical portion.

The second helical portion may be disposed such that a part thereof protrudes toward an end portion of a longitudinal direction of the base portion as viewed in the helical axis direction.

The first helical portion may include a line antenna pattern formed at least on opposite surfaces to facing surfaces of two substrates supported by the base portion.

The second helical portion may include an antenna pattern formed in a predetermined area including an end portion on the far side from the base portion and at least on opposite surfaces to facing surfaces of the two substrates.

The second helical portion may be formed using a conductive member obtained by bending a single plate.

The first helical portion may be formed using one of a line antenna pattern formed on a film-like substrate, a wire-shaped conductive member, a plate-like conductive member obtained by punching, and a line antenna pattern formed at least on opposite surfaces to facing surfaces of the two substrates supported by the base portion.

The second helical portion may be wounded in a plurality of winding numbers.

The second helical portion may be disposed such that a winding part far side from the first helical portion protrudes more toward a longitudinal one end side of the base portion than a winding part near side to the first helical portion as viewed in the helical axis direction.

The antenna portion may further comprise an antenna element connected to a tip end of the second helical portion and disposed along a top end portion of the second helical portion as viewed in the short-side direction perpendicular to the helical axis direction.

The base portion may be made of resin.

Advantages of the Invention

According to the present invention, it is possible to, in a low-profile antenna device having a limited space for the element, allow the entire element to function efficiently as an antenna in the limited space to improve antenna characteristics.

BRIEF DESCRIPTION OF THE DRAWINGS

FIG. 6 is a view illustrating antenna characteristics (AM) of the antenna device according to the first embodiment (Example 1) of the present invention and a conventional antenna device.

BEST MODE FOR CARRYING OUT THE INVENTION

Figure 1:
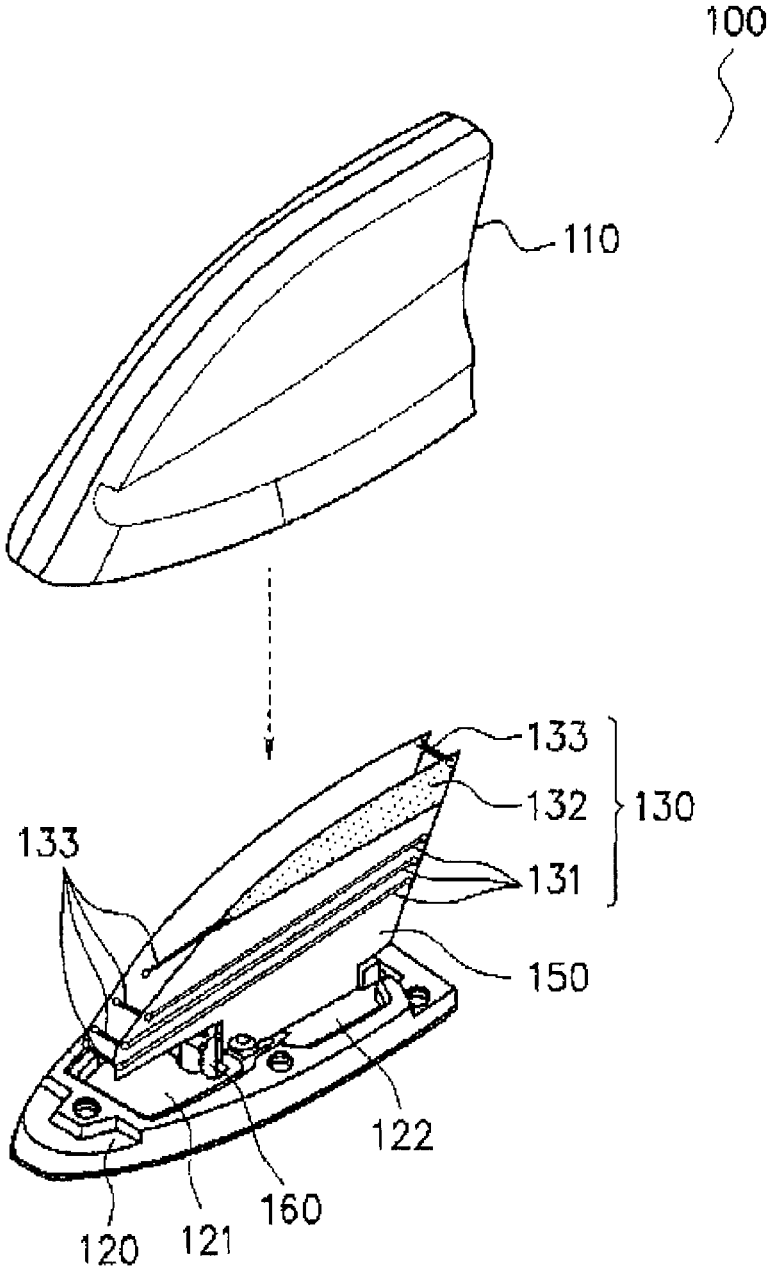
FIG. 1 is a view (perspective view) illustrating a configuration of an antenna device according to a first embodiment (Example 1) of the present invention.

The present invention has been derived from a viewpoint of how to allow the entire element to function efficiently as an antenna in a low-profile antenna device with a limited space for the element. In the present invention, the element that emits and receives radio waves is constituted by two portions (first helical portion and second helical portion) different in surface area, and the entire element is formed into a horizontally long (the height of the helical axis direction is smaller than the length in the direction perpendicular to the helical axis) helical shape (that is, the entire element is formed as a horizontally long helical element) so as to arrange a lower end of the second helical portion located above the first helical portion without overlapping with an upper end of the first helical portion. That is, the second helical portion is arranged so as not to cover the first helical portion as viewed in a direction passing perpendicularly through a helical axis. The first helical portion is provided with a function of adjusting a resonance frequency, and the second helical portion is provided with a function of adding an electrostatic capacitance. Hereinafter, embodiments of the present invention will be described with reference to the accompanying drawings.

First Embodiment

In a first embodiment of the present invention, a horizontally long helical element (first helical portion and second helical portion) is realized by forming an antenna pattern on two vertically arranged substrates. In an antenna portion of the present embodiment, metal conductive substance (e.g., copper) is etched to form an antenna pattern, and the antenna patterns of the respective substrates are connected by a conductive member (e.g., a wire). Thus, in the present embodiment, production of the helical element (horizontally long helical element) to which the present invention is applied does not take a lot of troubles and time. Further, antenna devices obtained in the present embodiment have constant quality and less variation in performance. Furthermore, in the present embodiment, fine adjustment for achieving target antenna characteristics can easily be made. In the following illustrative examples, a length of the second helical portion in a horizontal direction (longitudinal direction perpendicular to the helical axis), that is, a horizontal width of the second helical portion as viewed in a short-side direction perpendicular to the helical axis direction is made equal to or smaller than a horizontal width of the first helical portion (a configuration reverse to that of a common top-load type antenna in which a size of a top-load part is larger than that of another part). That is, the first helical portion located below the second helical portion is formed thicker than the second helical portion. However, the present invention is not limited to this, but a configuration may be employed in which the first helical portion is formed thinner than the second helical portion, depending on a size of a space for accommodating the antenna portion. Hereinafter, more specific examples of the present embodiment will be described as examples.

Example 1

An antenna device as a first example of the present embodiment includes an antenna portion that emits and receives radio waves and a base portion that supports the antenna portion, in which two substrates are vertically arranged on the base portion at a predetermined interval and in substantially parallel to each other. Line antenna patterns are formed on each of the substrates so as to linearly extend thereon and connected to each other to thereby form the first helical portion, and solid antenna patterns are formed above the first helical portion in a predetermined area including an end portion on an opposite side to the base portion and connected to each other to thereby form the second helical portion.

Figure 2:
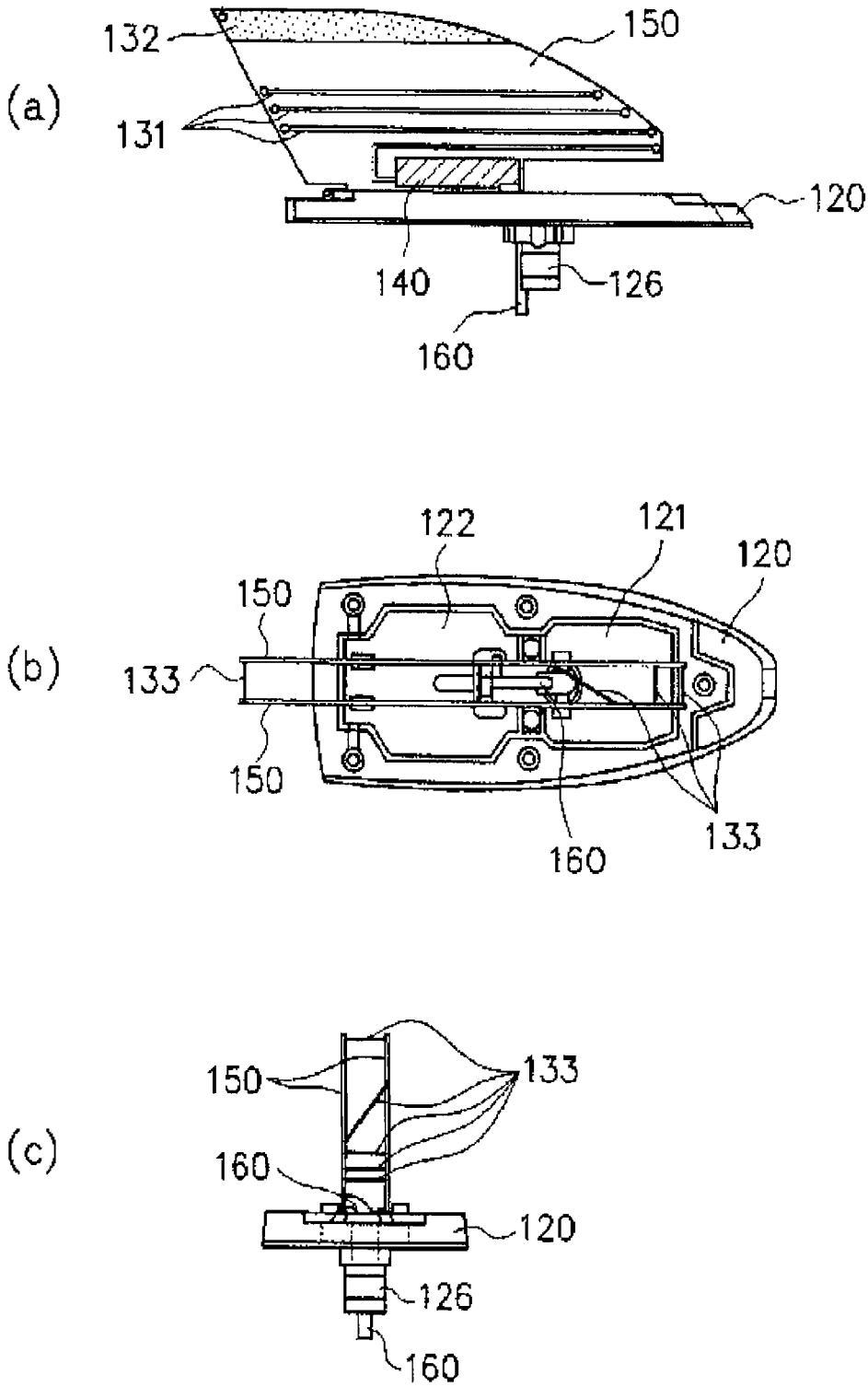
FIGS. 2(*a*), 2(*b*), and 2(*c*) are views (side view, top view, and front view) of the antenna device according to the first embodiment (Example 1) of the present invention.

FIG. 1 is a perspective view illustrating a configuration of an antenna device according to the present example, and FIGS. 2(*a*), 2(*b*), and 2(*c*) are a side view, a top view, and a front view, respectively, of the antenna device according to the present example. An antenna device 100 of the present example includes an antenna cover 110, a base portion 120 attached to a vehicle body in a state of being covered by the antenna cover 110, and an antenna portion 130 formed on substrates vertically arranged on the base portion 120.

The antenna cover 110 is formed of a radio wave transmitting synthetic resin and has a shark-fin shape as described above, that is, an outer shape tapered from an lower end portion thereof facing the base portion 120 toward an opposite side upper end portion thereof. The antenna cover 110 has an inner space that can house the substrates vertically arranged on the base portion 120.

The base portion 120 has, on a surface thereof facing the antenna cover 110, a patch antenna installation space 121 and an amplifier substrate accommodating space 122. The patch antenna installation space 121 is a space for installation of, e.g., a GPS (Global Positioning System) patch antenna or an SDARS (Satellite Digital Audio Radio Service) patch antenna which is commonly mounted in a product to be exported to Europe and the United States. In order for two substrates 150 to be arranged in a standing manner, supporting portions each sandwiching each substrate 150 are provided between the patch antenna installation space 121 and amplifier substrate accommodating space 122 and on a rear side of the amplifier substrate accommodating space 122.

The base portion 120 has, on a surface thereof facing the vehicle body, an antenna attachment portion 126 that is fitted to an attachment portion on the vehicle body so as to fix the antenna device 100. Further, a flexible base pad for waterproof purpose made of rubber or elastomer is fitted to an outer edge of the surface of the base portion 120 facing the vehicle body and around the antenna attachment portion 126 (FIG. 1 and FIGS. 2(*a*) to 2(*c*) each representing a state where the base pad is fitted) so as to be able to attach the base portion 120 to the vehicle in a watertight manner. Further, the base portion is generally made of a conductive metal so as to serve as a ground; however, in a case where sufficient ground characteristics can be obtained by a vehicle roof or a solid part of a circuit substrate, the base portion may be a resin base made of resin.

The antenna portion 130 includes a line pattern 131, a solid pattern 132, and a wire 133. The line pattern 131 is a line antenna pattern formed on the substrates 150 (on opposite surfaces to facing surfaces of the substrates) which is obtained by etching metal conductive substance (e.g., copper). The solid pattern 132 is a solid antenna pattern formed on the substrates 150. A surface area (area of an air-contact part for radio wave emission) per unit length of the solid pattern 132 is larger than that of the line pattern 131. The solid pattern 132 is formed at an upper end portion (end portion on an opposite side to the base portion 120) of each substrate 150, and the line pattern 131 is formed at a lower portion (base 120 side) of each substrate 150 such that an upper end of the line pattern 131 is not overlapped with a lower end of the solid pattern 132.

The above antenna patterns can be formed not only by the copper etching but also by various methods. Further, although the solid pattern 132 is used to constitute the second helical portion, a high-density matrix pattern may be used if it forms (has a large surface area per unit length) an antenna pattern having a predetermined area on the substrate.

A connection part (through-hole) for connecting the patterns by the wire 133 is formed on the two substrates 150 at portions corresponding to both end portions of the line pattern 131 and both end portions of the solid pattern 132, and the through-hole formed in one substrate and that formed in the other substrate are connected by the wire 133. A lower end (base portion side end portion) of the line pattern 131 is connected to an amplifier portion 140. The through-holes formed respectively in the two substrates at positions substantially facing each other are connected by the wire 133, whereby the first helical portion is defined by the line pattern 131 and wire 133. Further, through-holes are formed at positions corresponding to rear end portions (end portions on the amplifier substrate accommodating space 122) of the solid pattern and are connected by the wire 133, whereby the second helical portion is defined by the solid pattern 132 and wire 133.

A through-hole formed at a position corresponding to a tip end portion (tip end of the helical shape) of the line pattern 131 is connected not to the through-hole of the solid pattern 132 formed in the same substrate but to the through-hole of the solid pattern formed on the opposing substrate. Thus, the first and second helical portions are connected to each other by the wire while maintaining the helical shape as a whole, whereby the element having a horizontally long shape as a whole including the antenna patterns (line pattern 131 and solid pattern 132) formed on the two facing substrates and wire connecting the patterns is obtained.

The first helical portion constituted by the line pattern 131 and wire 133 (wires connecting the respective line patterns) performs frequency adjustment in addition to emission of radio waves. That is, the first helical portion has a function of achieving a resonance frequency at which the antenna portion 130 is made to resonate in an FM band, and FM receiving performance can be improved by this function. Further, the second helical portion constituted by the solid pattern 132 and wire 133 (wire connecting two solid patterns) has a function of obtaining an electrostatic capacitance in addition to emission of radio waves. That is, the second helical portion has a function of adding a predetermined amount or more of electrostatic capacitance to the antenna portion 130, contributing to improvement of AM receiving performance and receiving performance of horizontally polarized wave of FM.

Figure 3:
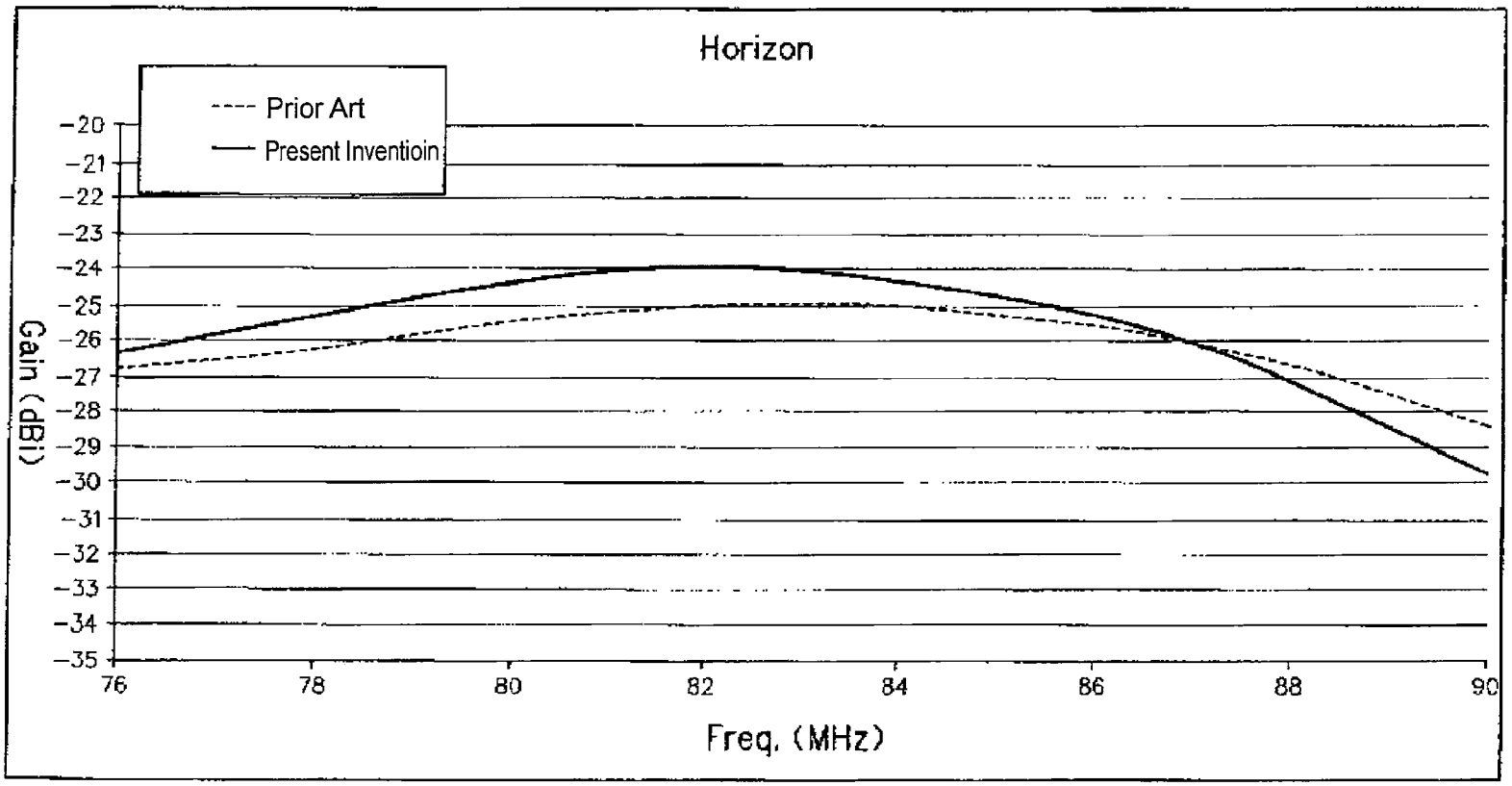
FIG. 3 is a view illustrating antenna characteristics (FM/horizontally polarized wave) of the antenna device according to the first embodiment (Example 1) of the present invention and a conventional antenna device.
Figure 4:
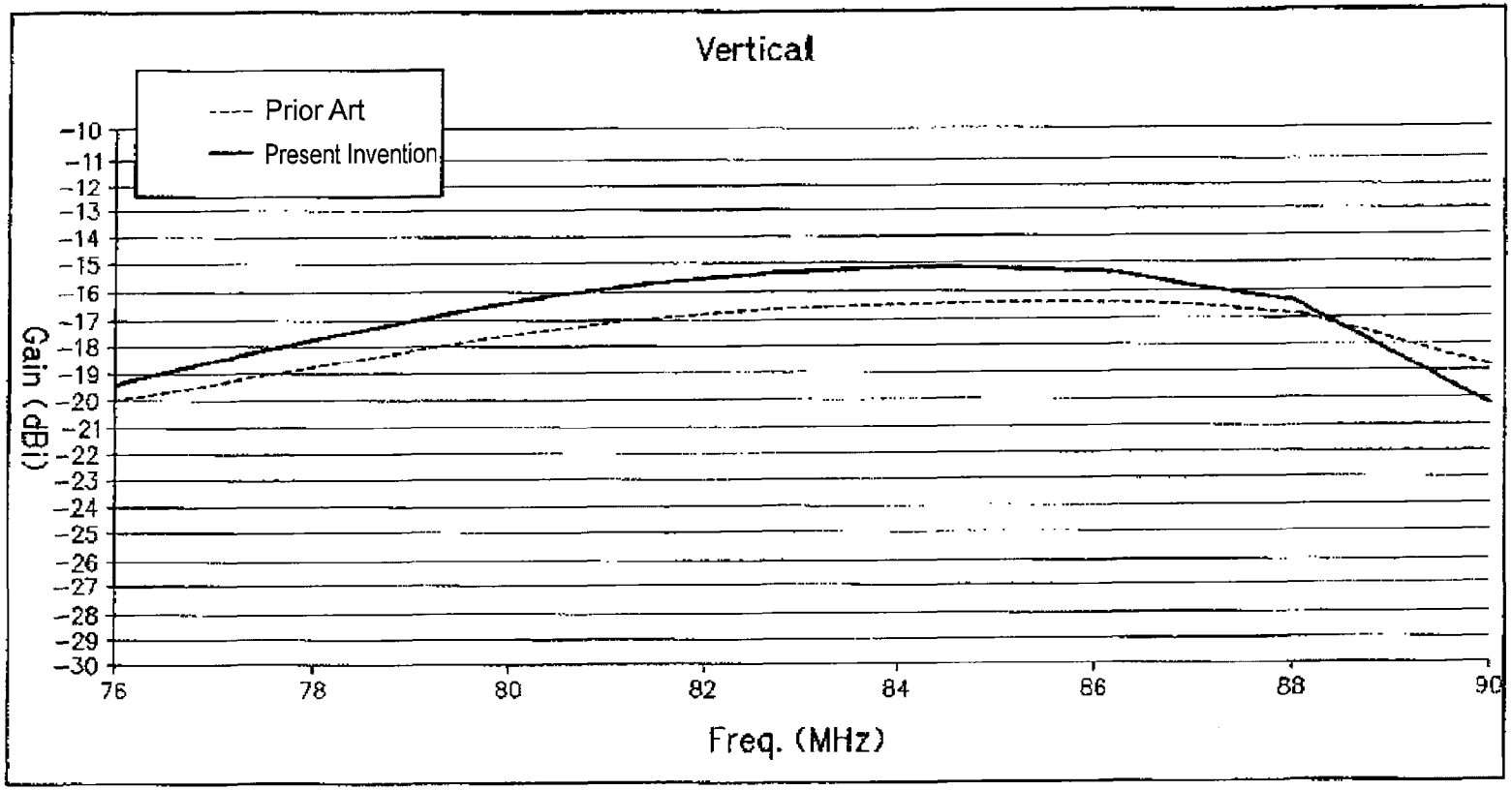
FIG. 4 is a view illustrating antenna characteristics (FM/vertically polarized wave) of the antenna device according to the first embodiment (Example 1) of the present invention and a conventional antenna device.
Figure 5:
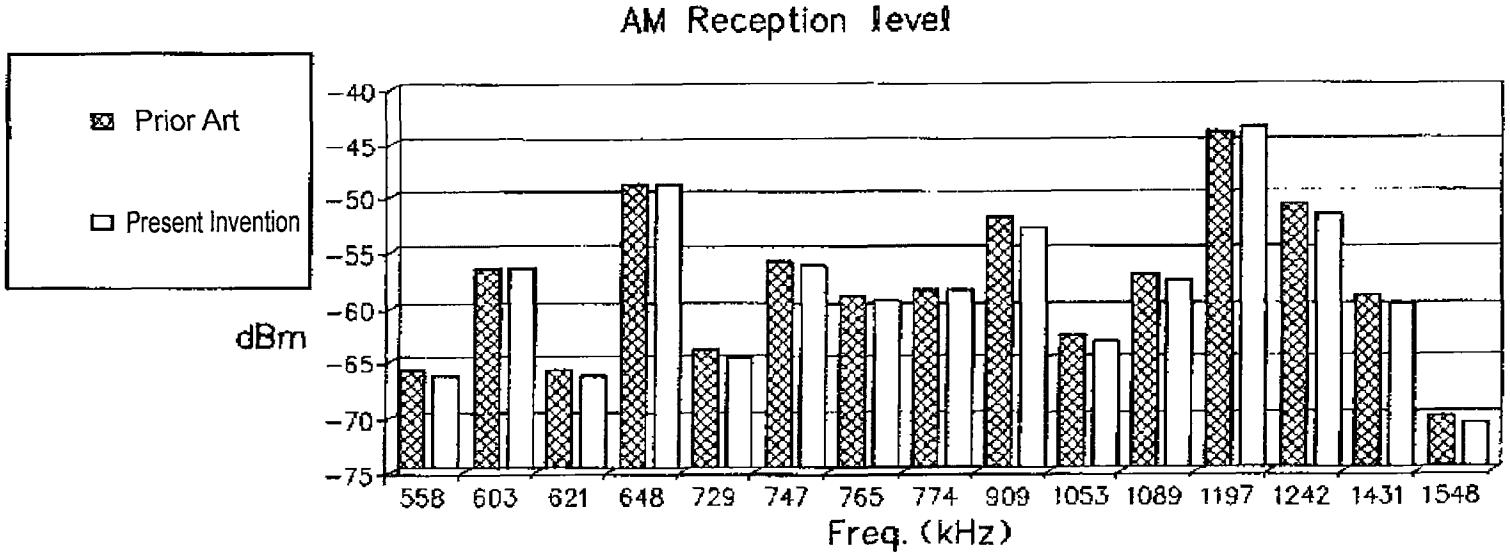
FIG. 5 is a view illustrating antenna characteristics (AM) of the antenna device according to the first embodiment (Example 1) of the present invention and a conventional antenna device.

FIGS. 3 to 6 are views for comparing antenna characteristics of an antenna device according to the present invention and a conventional (e.g., Patent Document 1) antenna device. FIG. 3 represents FM-Passive performance (horizontally polarized wave), FIG. 4 represents FM-Passive performance (vertically polarized wave), FIG. 5 represents AM antenna characteristics (reception level), and FIG. 6 represents AM audibility evaluation. The FM-Passive performance is higher in the antenna device of the present invention as illustrated in FIGS. 3 and 4. The AM antenna characteristics (reception level) are substantially equivalent between the antenna device of the present invention and conventional one as illustrated in FIG. 5; however, in terms of the AM audibility evaluation, a better result (low noise floor and superior in audibility) is obtained in the antenna device of the present invention as illustrated in FIG. 6.

In the conventional antenna device, the coil only performs inductance correction, and substantially only the hat-shaped top part emits radio waves to function as an antenna, which degrades antenna efficiency. On the other hand, as described above, in the antenna device according to the present invention, the two antenna patterns (line pattern 131 and solid pattern 132) formed on two facing substrates and wire connecting the patterns constitute the element (helical element) having a helical shape as a whole. The first helical portion constituted by the line patterns 131 is provided with the frequency adjustment function that makes the antenna portion 130 to resonate in an FM band, and the second helical portion constituted by the solid patterns 132 is provided with the function of adding a predetermined amount or more of electrostatic capacitance to the antenna portion 130. Further, both the helical portions are provided with a function of emitting radio waves. As a result, unlike the conventional antenna device, the entire antenna portion is utilized as an antenna, resulting in high antenna efficiency. Such a configuration in which the entire antenna portion constitutes the helical element and the helical element is provided with the frequency adjustment function (first helical portion) and electrostatic capacitance adding function (second helical portion) contributes to the satisfactory results (FIGS. 3 to 6) of the antenna characteristics.

Figure 7:
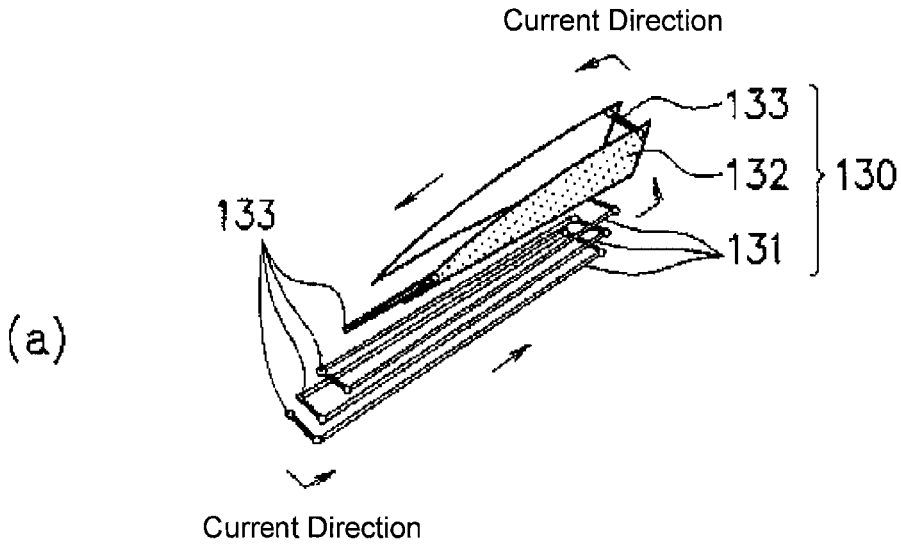
FIGS. 7(*a*) and 7(*b*) are views each illustrating a configuration of a main part (first and second helical portions) of the antenna device according to the first embodiment (Example 1) of the present invention.
Figure 7:
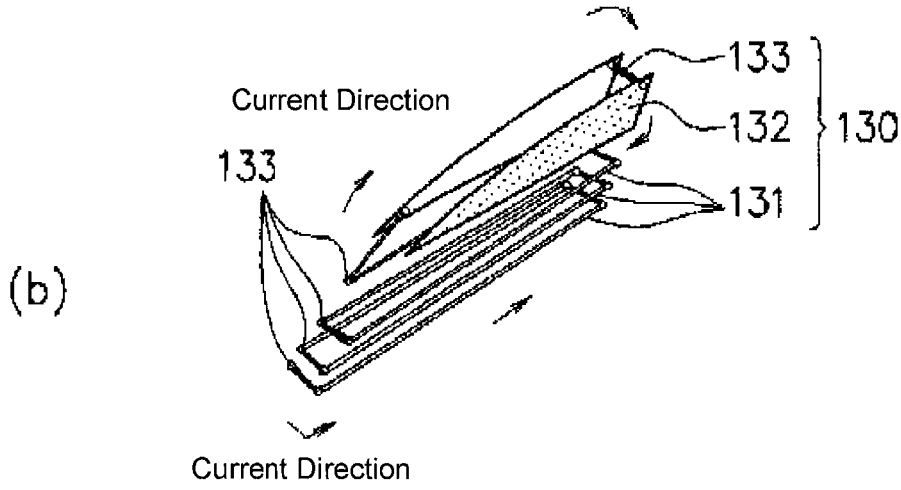

As described above, in the present example, the through-hole at the tip end of the first helical portion and the through-hole of the second helical portion formed in the different substrate from the substrate in which the connection part is formed are connected by the wire. That is, as illustrated in FIG. 7(*a*), when current is applied after the connection has been made, a direction of the current in the first helical portion and that in the second helical portion are the same on each substrate, so that the entire antenna portion forms a large helical element. On the other hand, when the through-hole at the tip end of the first helical portion and the through-hole of the second helical portion formed in the same substrate as the substrate in which the connection part is formed are connected by the wire, the current direction in the first helical portion and that in the second helical portion are opposite to each other on each substrate as illustrated in FIG. 7(*b*), so that only the first helical portion forms the helical element.

Figure 8:
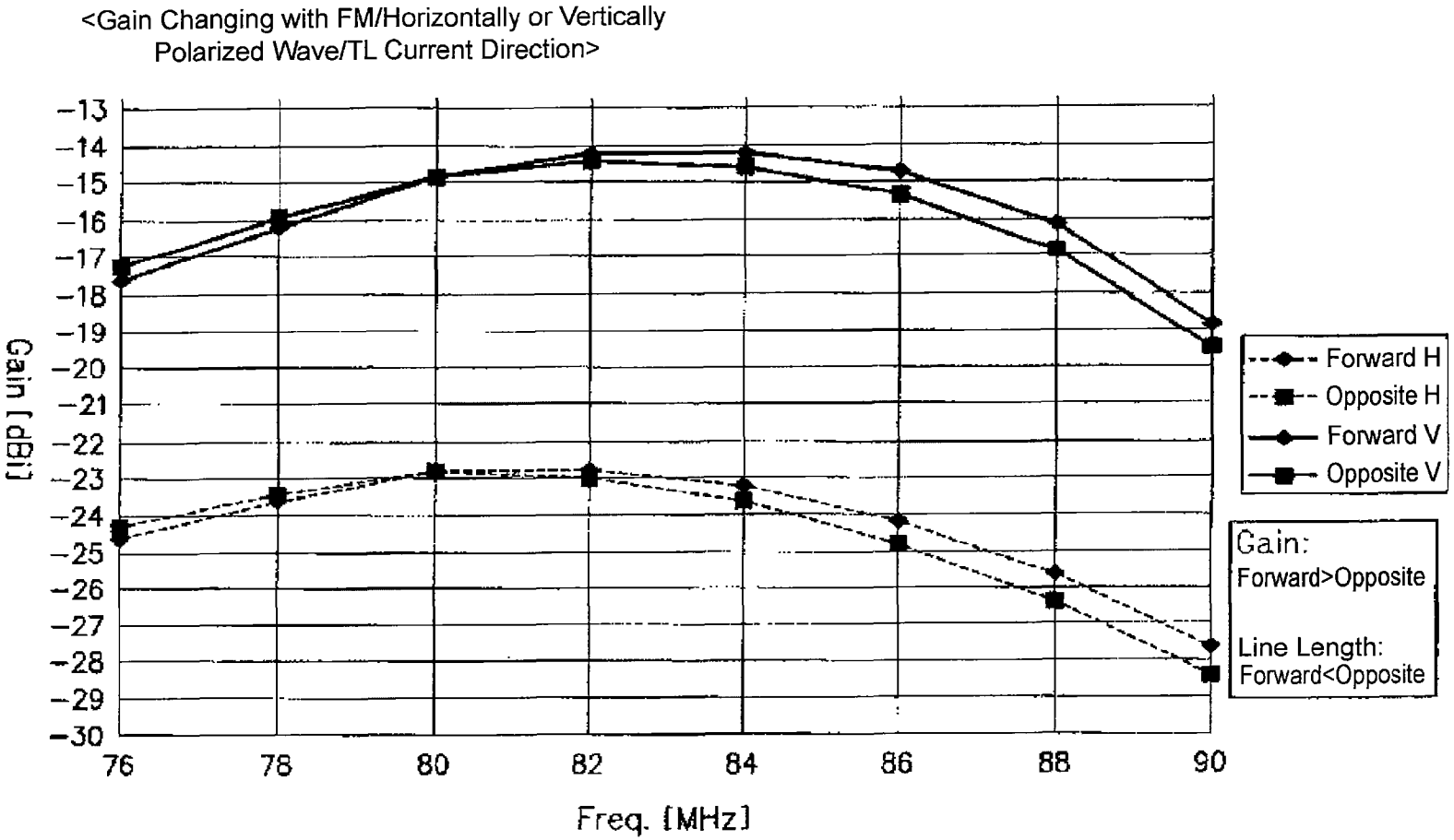
FIG. 8 is a view illustrating antenna characteristics (gain changing with FM/horizontally or vertically polarized wave/TL current direction) of the antenna device according to the first embodiment (Example 1) of the present invention.

FIG. 8 illustrates antenna characteristics obtained in both cases where the connection is made such that the current direction in the first and second helical portions are the same on each substrate and such that the current direction in the first and second helical portions are opposite to each other on each substrate. In FIG. 8, a state where the current flows in the same direction is represented as "forward direction", a state where the current flows in the opposite direction is represented as "opposite direction", a horizontally polarized wave is as "H", and a vertically polarized wave is as "V". As is clear from FIG. 8, for both the horizontally and vertically polarized waves, a gain of the entire antenna is better as a whole in the case where the connection is made such that the current direction in the first and second helical portions are the same. This is because when the connection is made such that the current direction in the first and second helical portions are the same on each substrate, the entire antenna portion forms a large helical element to eliminate a cancellation due to a difference in current vector direction.

Further, as described above, in the present example, the antenna pattern of the first helical portion is formed on the substrate as a linear line pattern. Examples of the line pattern may include, in addition to the linear line pattern, various patterns such as a wavy line and a curved line pattern. In a case where the line pattern is formed as the linear line pattern, a length of the pattern (line) that can be printed on the substrate is smaller than in a case where the line pattern is formed as the wavy line pattern or curved line pattern. That is, when the helical is to be formed using the same element length, the element needs to be wound more largely (in a length exceeding a longitudinal direction length of the substrate) in the case of the linear line pattern. For example, in the case where the line pattern is formed as the wavy line pattern or curved line pattern, the first helical portion may be formed by connecting in the most direct way between the through-holes formed in the substrates by the wire; however, in the case of the linear line pattern, the line pattern on one substrate needs to be extended outside the substrate from the through-hole and then connected to the other substrate. That is, it can be said that when the line pattern is formed on the substrate as the wavy line pattern or curved line pattern, a size of the entire antenna can be reduced (the volume of the antenna can be reduced) (longitudinal length is reduced as compared with the case where the line pattern is formed as the linear line pattern).

Figure 9:
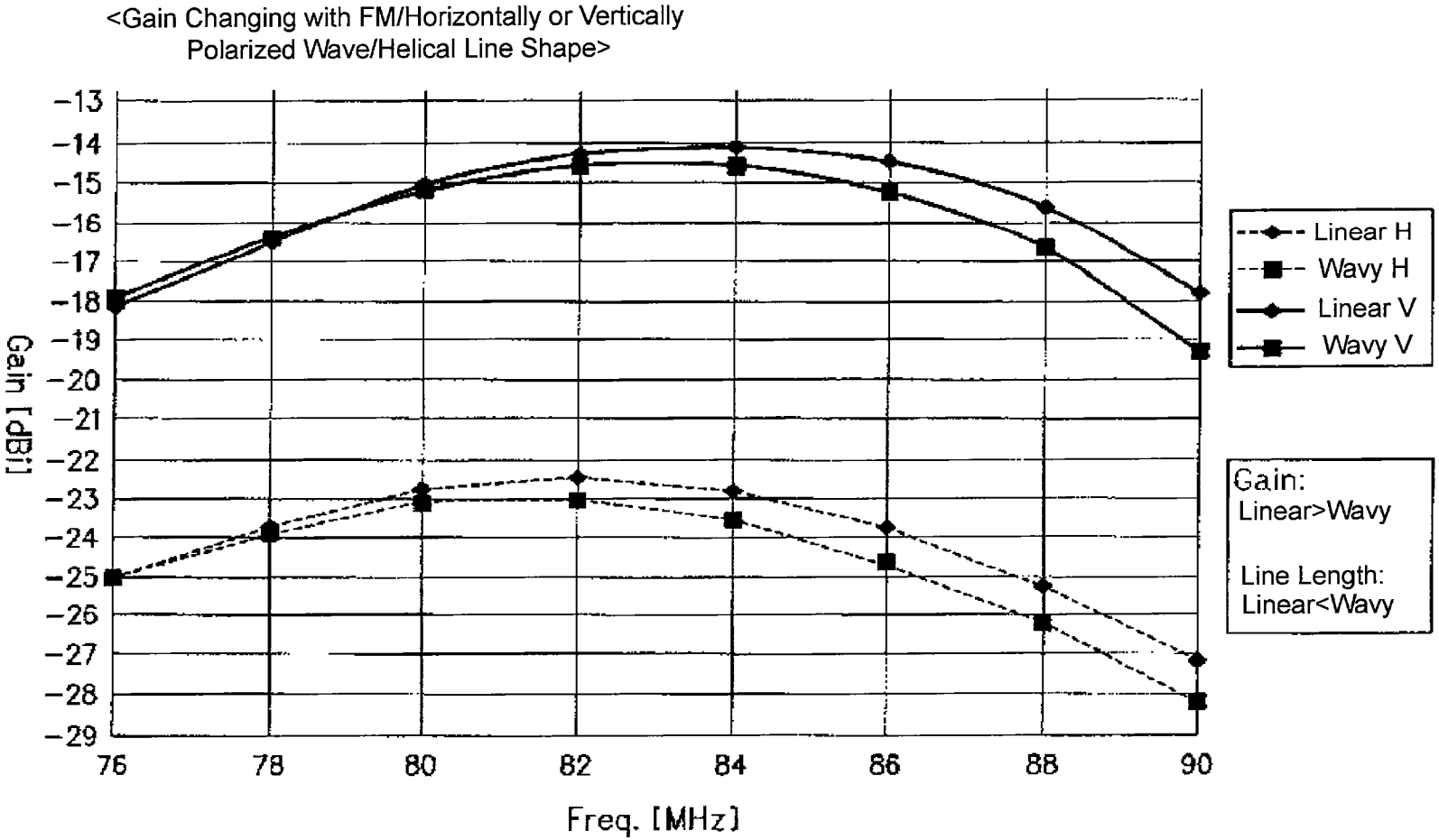
FIG. 9 is a view illustrating antenna characteristics (gain changing with FM/horizontally or vertically polarized wave/helical line shape) of the antenna device according to the first embodiment (Example 1) of the present invention.

FIG. 9 illustrates antenna characteristics obtained in both the cases where the antenna pattern of the first helical portion is formed as the linear line pattern and where the antenna pattern is formed as the wavy line pattern. As is the case with FIG. 8, the horizontally polarized wave is represented as "H", and vertically polarized wave is as "V". As can be seen from FIG. 9, for both the horizontally and vertically polarized waves, a gain of the entire antenna is better as a whole in the case where the antenna pattern of the first helical portion is formed as the linear line pattern. This is because when the antenna pattern of the first helical portion is formed as the linear line pattern, the line length is reduced to increase the volume of the entire antenna (e.g., a coarse-pitch helix (see Example 2 to be described later)) as compared with a case where the antenna pattern is formed as the wavy line pattern and the gain is correspondingly improved. Conversely, when the antenna pattern of the first helical portion is formed as the wavy line pattern, the entire antenna can be reduced in volume, but the gain is correspondingly sacrificed.

Further, as described above, in the present embodiment, the line pattern is formed at the lower portion (base portion side) of the vertically arranged substrate to arrange the first helical portion, the solid pattern is formed in a predetermined area including the upper end portion to arrange the second helical portion, and the first and second helical portions are connected by wire to form the antenna portion such that the entire antenna forms a large helical element. In order to make the entire antenna function as the large helical element, it is possible to employ a configuration using only the first helical portion. In this case, the line pattern may be extended to the upper end (end portion on the opposite side to the base portion) of the substrate while maintaining a predetermined interval in the vertical direction.

Figure 10:
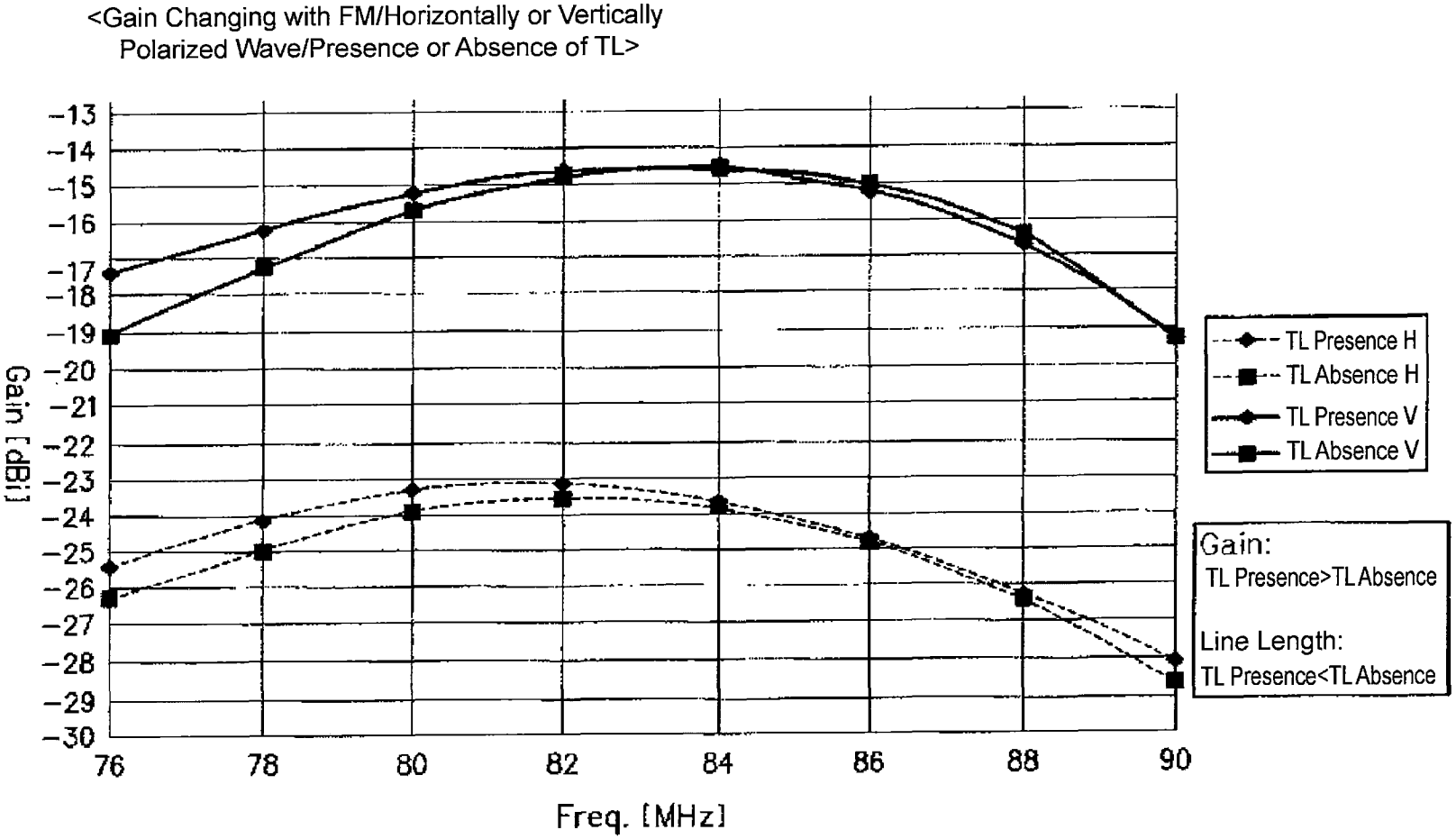
FIG. 10 is a view illustrating antenna characteristics (gain changing with FM/horizontally or vertically polarized wave/presence or absence of TL) of the antenna device according to the first embodiment (Example 1) of the present invention.

FIG. 10 illustrates antenna characteristics obtained in both the cases where the antenna portion is constituted by the first and second helical portions and where the antenna portion is constituted by only the first helical portion. In FIG. 10, the case where the antenna portion is constituted by the first and second helical portions is represented as "presence of TL", the case where the antenna portion is constituted by only the first helical portion is as "absent of TL", horizontally polarized wave is as "H", and vertically polarized wave is "V". As can be seen from FIG. 10, for both the horizontally and vertically polarized waves, a gain of the entire antenna is better as a whole in the case where the antenna portion is constituted by the first and second helical portions. This is because presence of the second helical portion including the solid pattern contributes comparatively much to an increase in an amount of radiation, that is, the presence of the second helical portion including the solid pattern causes strong current to be distributed in a higher part (higher area of the vertically arranged substrate) to increase the amount of radiation in the horizontal direction.

The line pattern constituting the first helical portion may be formed as a thick line pattern (with an increased line width) or as a thin line pattern (with a decreased line width). In general, the thicker the element, the wider a resonance bandwidth becomes, and the more an average band gain increases. Thus, in order to increase the gain of the entire antenna, it is preferable to make the line pattern constituting the first helical portion as thick as possible (increase the line width as much as possible). However, it should be noted that when a space between the patterns is too narrow, a flux coupling occurs to result in a high resonance point, making it impossible to achieve resonance at a desired frequency.

Example 2

Figure 11:
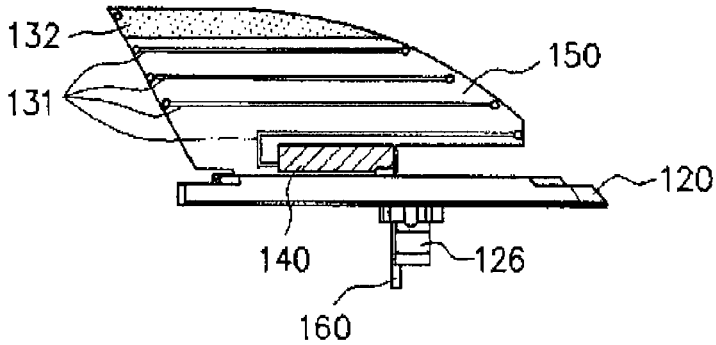
FIG. 11 is a view (side view) illustrating a configuration of an antenna device according to the first embodiment (Example 2) of the present invention.

An antenna device of Example 2 of the present embodiment has substantially the same configuration as that of the antenna device of Example 1 but differs from Example 1 (see FIG. 2(*a*)) in that, as illustrated in FIG. 11, an interval of the line pattern (interval between the patterns) constituting the first helical portion is made larger to form a coarse-pitch helix.

Figure 12:
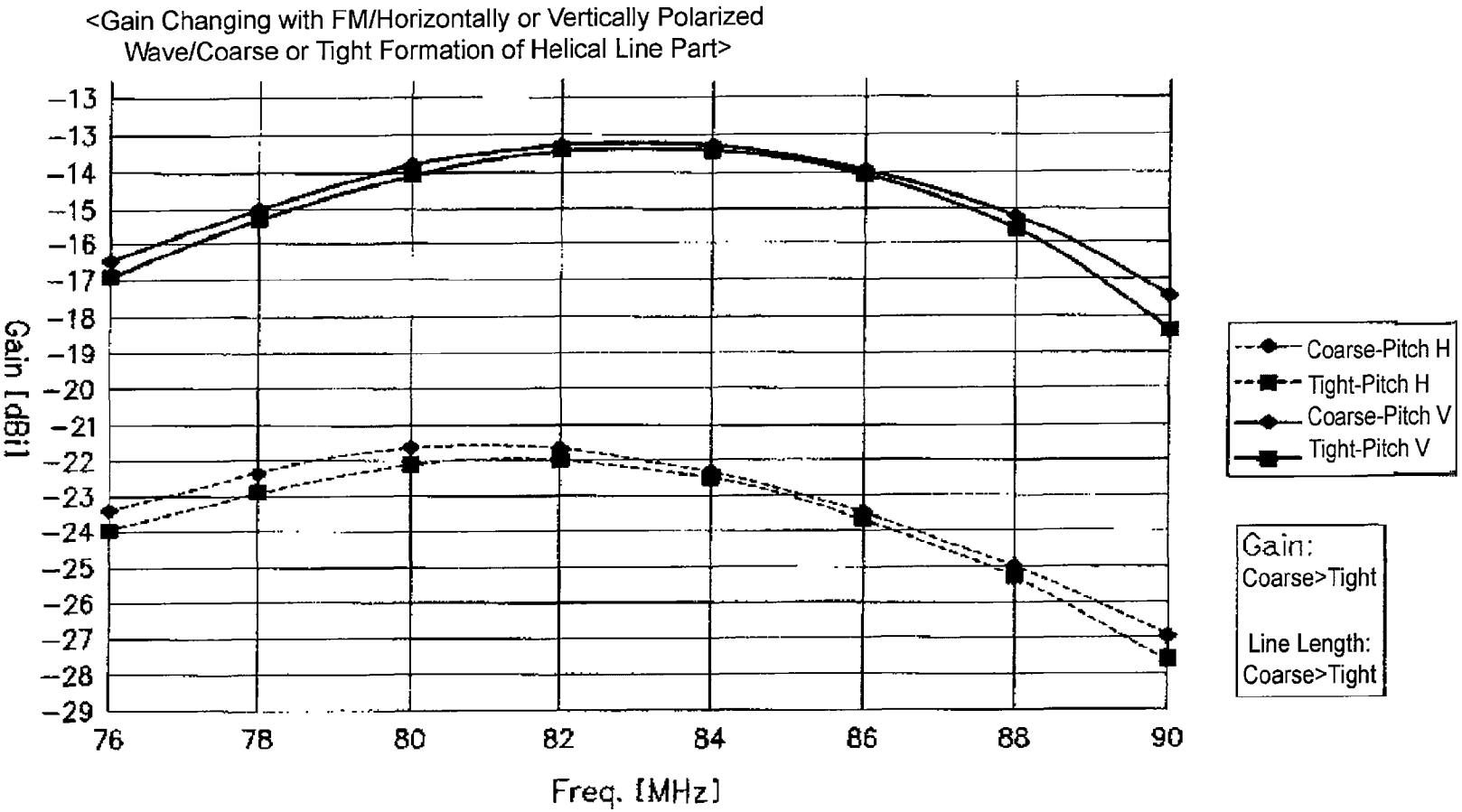
FIG. 12 is a view illustrating antenna characteristics (gain changing with FM/horizontally or vertically polarized wave/coarse or tight formation of helical line part) of the antenna device according to the first embodiment (Example 2) of the present invention.

FIG. 12 illustrates antenna characteristics obtained in both the cases where the first helical portion is formed as the coarse-pitch helix and where the first helical portion is formed as a tight-pitch helix. As is the case with FIG. 10, the horizontally polarized wave is represented as "H", and vertically polarized wave is as "V" in FIG. 12. As can be seen from FIG. 12, for both the horizontally and vertically polarized waves, a gain of the entire antenna is better as a whole in the case where the first helical portion is formed as the coarse-pitch helix. This is because when the first helical portion is formed as the coarse-pitch helix, even though an inductance is increased, an imaginary number value is increased to narrow the resonance bandwidth and to increase a loss, resulting in an absolute reduction of energy amount to be radiated from the antenna. For this reason, the gain of the entire antenna becomes improved in the coarse-pitch helix than in the tight-coarse helix.

Example 3

Figure 13:
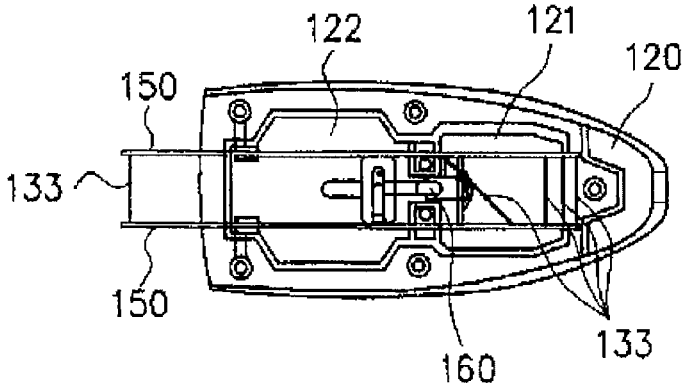
FIG. 13 is a view (top view) illustrating a configuration of an antenna device according to the first embodiment (Example 3) of the present invention.

An antenna device of Example 3 of the present embodiment has substantially the same configuration as that of the antenna device of Example 1 but differs from Example 1 (see FIG. 2(*b*)) in that, as illustrated in FIG. 13, an interval between the two substrates vertically arranged on the base portion is larger to make a diameter of the helical shape of the antenna portion constituted by the first and second helical portions larger. Note that, in the present example, it is possible to make the interval between the two substrates larger than the interval between the line patterns.

Figure 14:
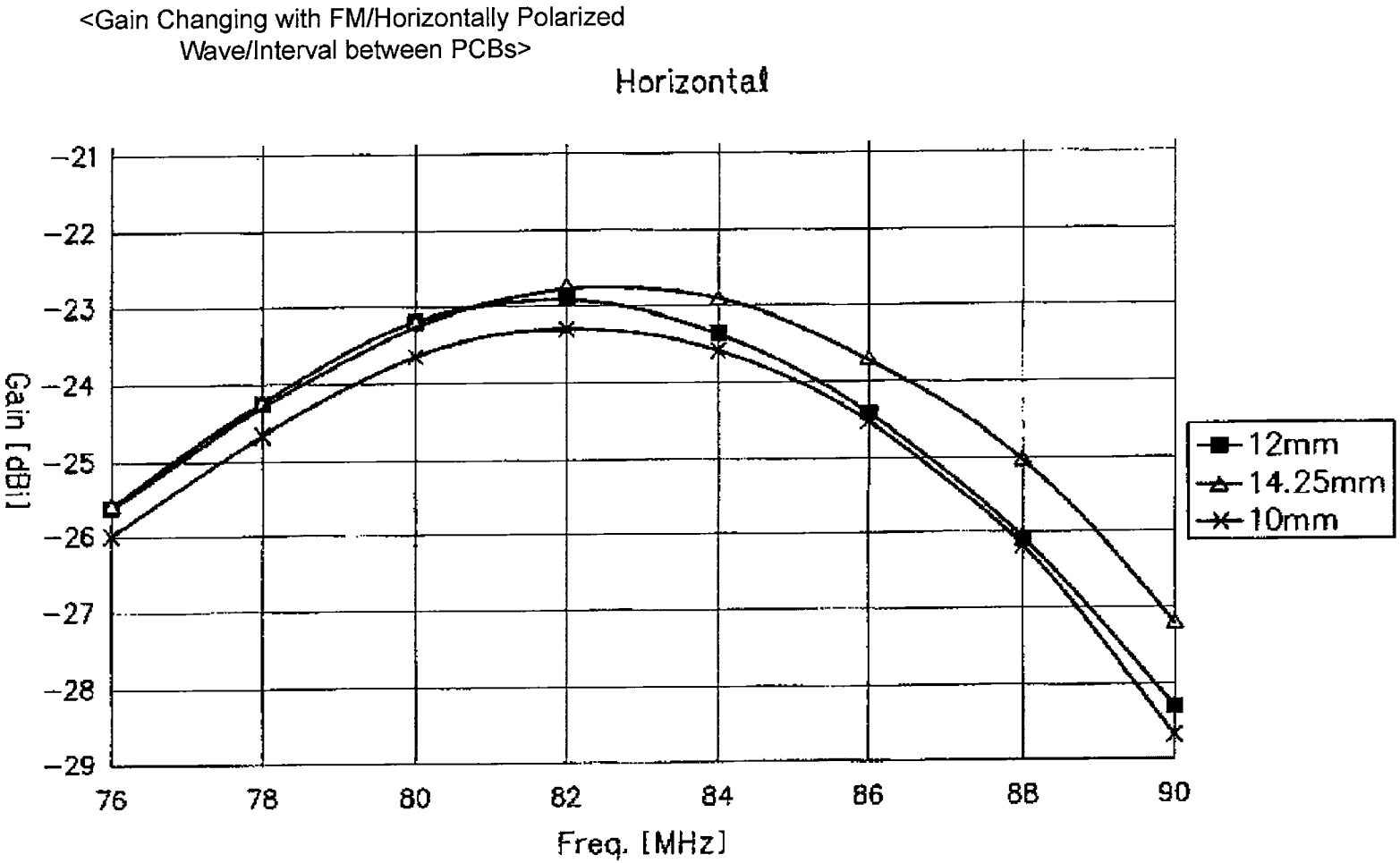
FIG. 14 is a view illustrating antenna characteristics (gain changing with FM/horizontally polarized wave/interval between PCBs) of the antenna device according to the first embodiment (Example 3) of the present invention.
Figure 15:
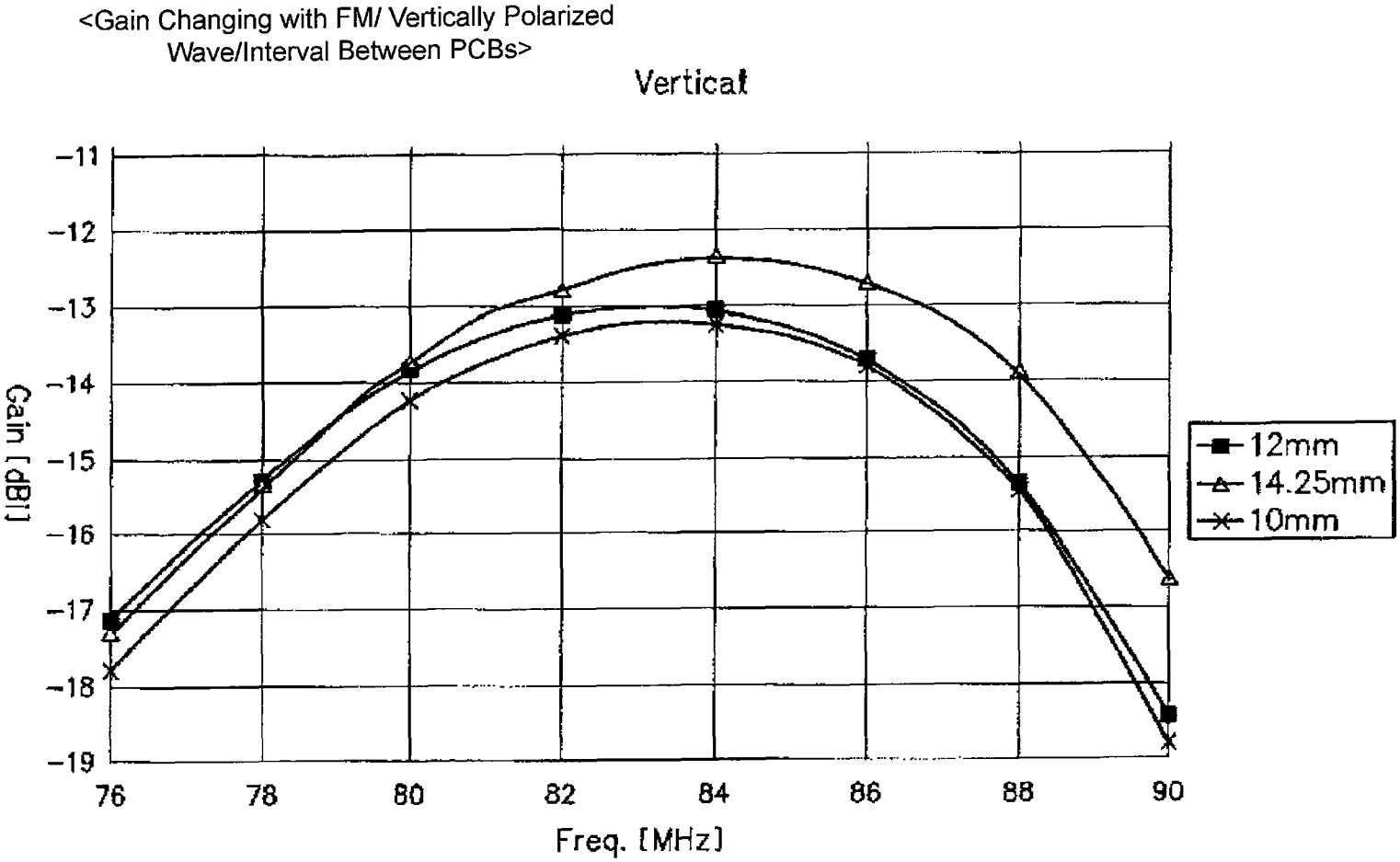
FIG. 15 is a view illustrating antenna characteristics (gain changing with FM/vertically polarized wave/interval between PCBs) of the antenna device according to the first embodiment (Example 3) of the present invention.

FIGS. 14 and 15 each illustrate antenna characteristics obtained in cases where the interval between the two substrates is set to 10 mm, 12 mm, and 14.25 mm, respectively. FIG. 14 represents the characteristics of the horizontally polarized wave, and FIG. 15 represents the characteristics of the vertically polarized wave. As can be seen from FIGS. 14 and 15, for both the horizontally and vertically polarized waves, a gain of the entire antenna becomes more improved as the interval between the two substrates is increased. This is because when the interval between the two substrates is increased, the first helical portion can be formed as the coarse-pitch helix, so that, for the same reason described in Example 2, the gain of the entire antenna becomes improved relatively as compared with a case where the interval between the two substrates is reduced. Further, the increase in the interval between the two substrates makes it easier for radio waves to be radiated from the facing antenna patterns (first and second helical portions), thereby increasing an average gain.

Example 4

Figure 16:
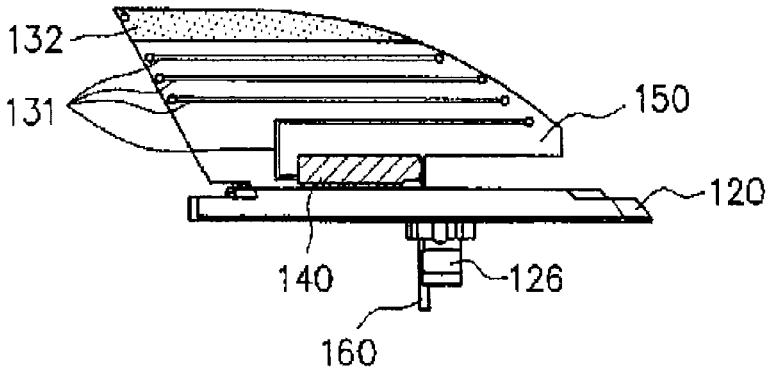
FIG. 16 is a view (side view) illustrating a configuration of an antenna device according to the first embodiment (Example 4) of the present invention.

An antenna device of Example 4 of the present embodiment has substantially the same configuration as that of the antenna device of Example 1 but differs from Example 1 (see FIG. 2(*a*)) in that, as illustrated in FIG. 16, the first helical portion is disposed more distant from a GND (amplifier portion 140). The GND mentioned here plays a role equivalent to a ground base regarded as being equivalent to the ground (the same applies hereinafter).

Figure 17:
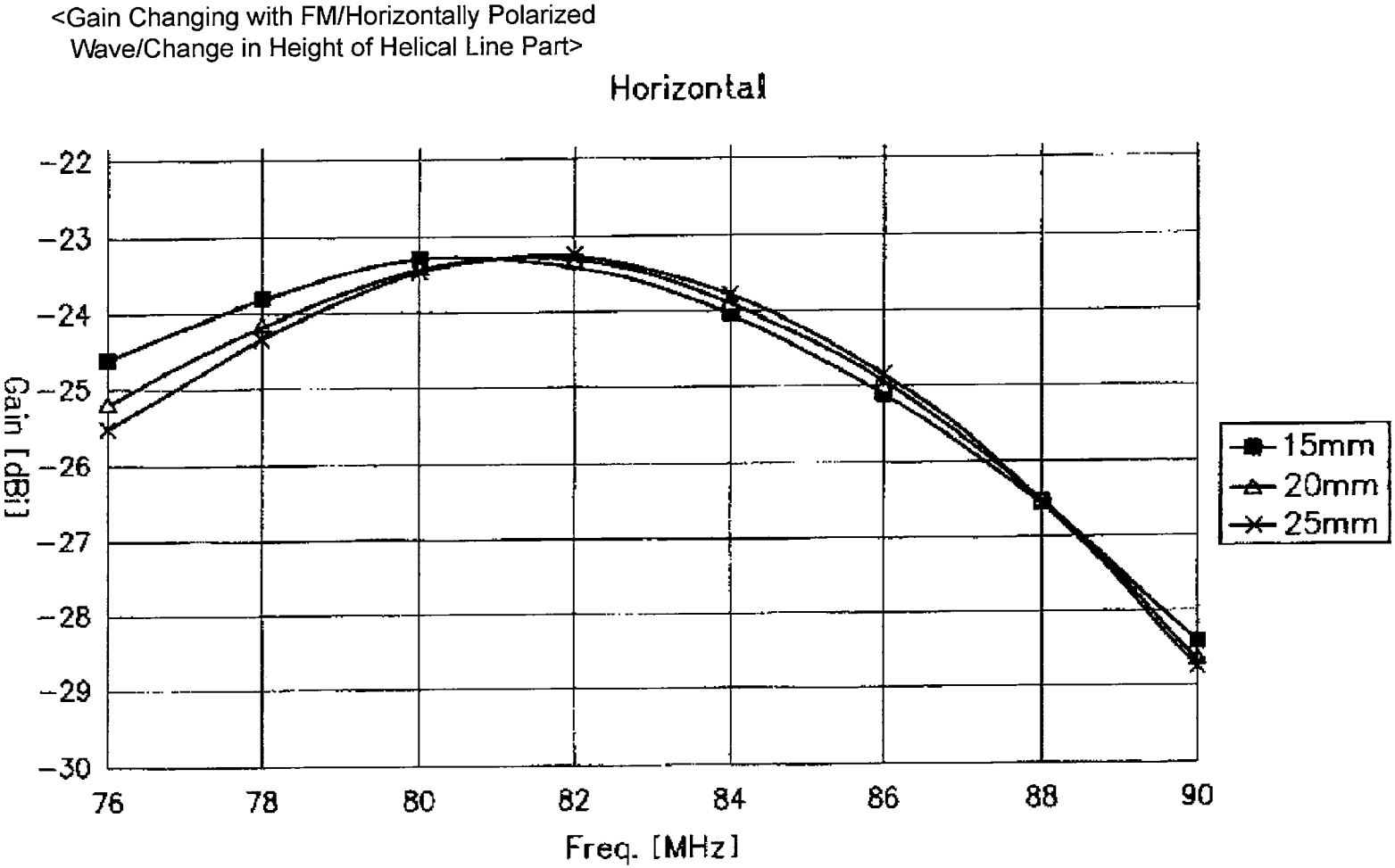
FIG. 17 is a view illustrating antenna characteristics (gain changing with FM/horizontally polarized wave/change in height of helical line part) of the antenna device according to the first embodiment (Example 4) of the present invention.
Figure 18:
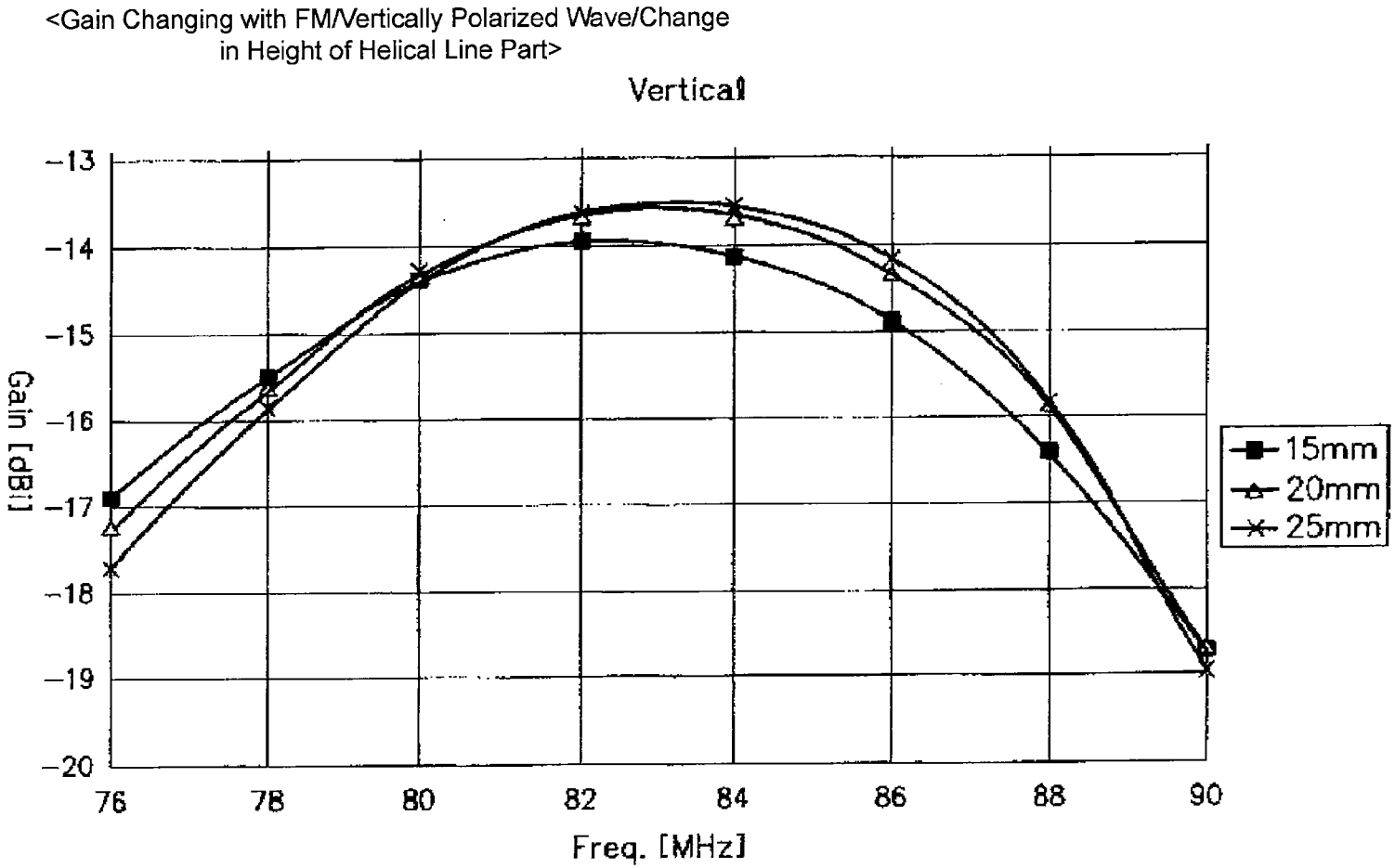
FIG. 18 is a view illustrating antenna characteristics (gain changing with FM/vertically polarized wave/change in height of helical line part) of the antenna device according to the first embodiment (Example 4) of the present invention.

FIGS. 17 and 18 each illustrate antenna characteristic obtained in cases where a distance between an installation surface on the base portion and a lower end of the first helical portion is set to 15 mm, 20 mm, and 25 mm, respectively. FIG. 17 represents the characteristics of the horizontally polarized wave, and FIG. 18 represents the characteristics of the vertically polarized wave. As can be seen from FIG. 17, little difference is found in the antenna characteristics for the horizontally polarized wave. However, as can be seen from FIG. 18, for the vertically polarized wave, a gain of the entire antenna becomes more improved as the vertical position of the first helical portion from the installation surface of the base portion is increased to increase the distance between the first helical portion and GND (amplifier portion 140). This is because the closer the first helical portion is to the second helical portion, the better radio wave radiation efficiency of the first helical portion and, conversely, the closer the first helical portion is to the base portion, the worse the radio wave radiation efficiency thereof.

Example 5

Figure 19:
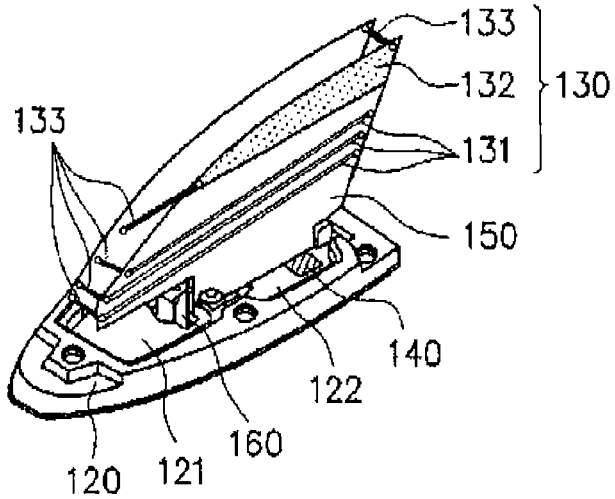
FIG. 19 is a view (perspective view) illustrating a configuration of an antenna device according to the first embodiment (Example 5) of the present invention.

An antenna device of Example 5 of the present embodiment has substantially the same configuration as that of the antenna device of Example 1 but differs from Example 1 in that, as illustrated in FIG. 19, the GND (amplifier portion 140) is disposed not on the substrate but on the base portion. That is, in the present example, the amplifier portion 140 is disposed on the amplifier substrate accommodating space 122, and only the antenna patterns (line pattern 131, solid pattern 132) are formed on the substrate.

Figure 20:
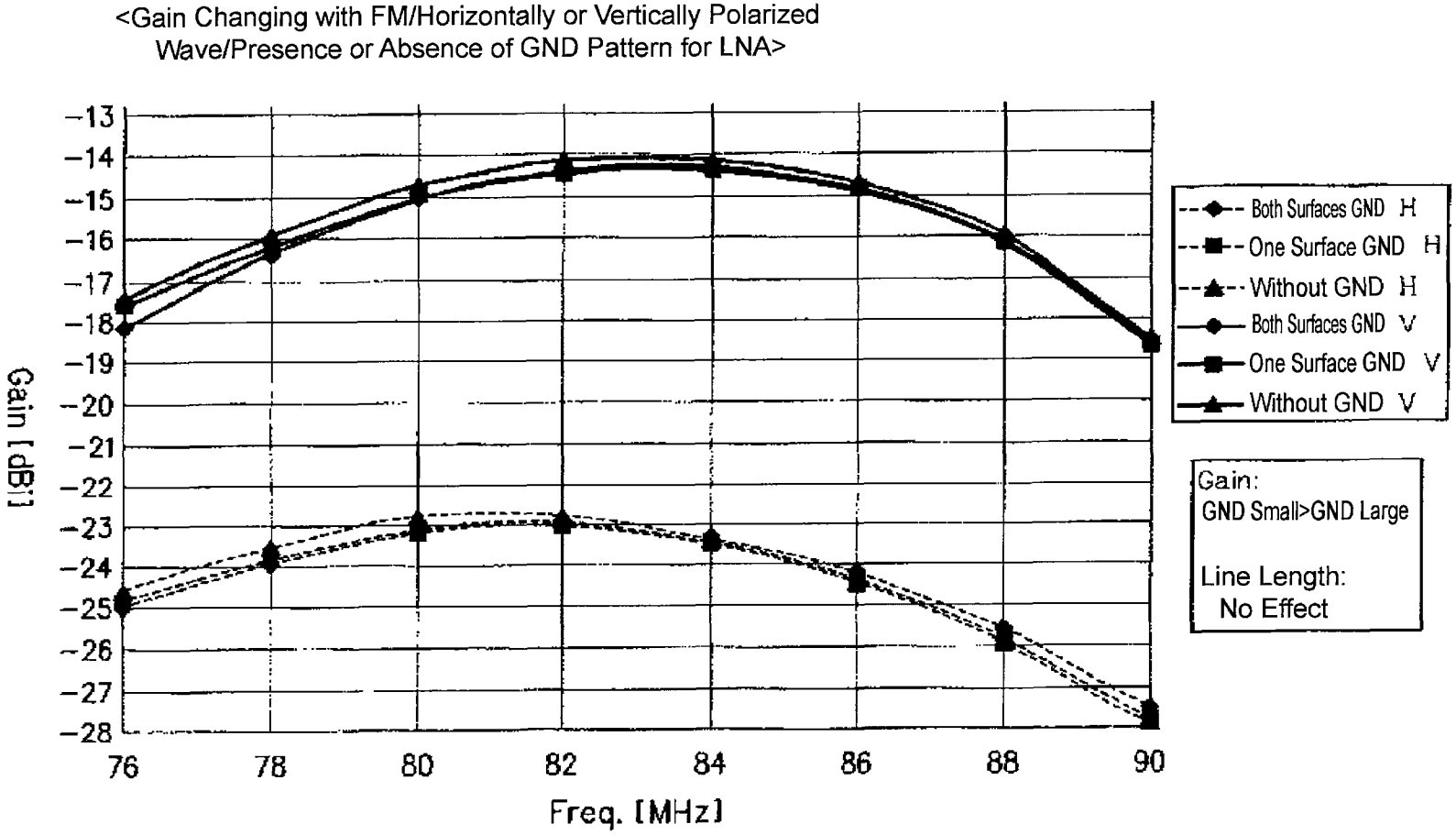
FIG. 20 is a view illustrating antenna characteristics (gain changing with FM/horizontally or vertically polarized wave/presence or absence of GND pattern for LNA) of the antenna device according to the first embodiment (Example 5) of the present invention.

FIG. 20 illustrates antenna characteristics obtained in cases where the GND (amplifier portion 140) is disposed on both surfaces (front and back) of the substrate, where the GND is disposed on one surface thereof, and where the GND is not disposed on the substrate but on the base portion 120. The case where the GND is disposed on both surfaces (front and back) of the substrate is represented as "GND (front and back surfaces)", the case where the GND is disposed on one surface thereof is as "GND (only back surface)", the case where the GND is not disposed on the substrate but on the base portion is as "NO GND", the horizontally polarized wave is as "H", and vertically polarized wave is as "V". As can be seen from FIG. 20, little difference is found in the antenna characteristics for the horizontally polarized wave. However, for the vertically polarized wave, a gain of the entire antenna is better in the case where the GND is disposed not on the substrate but on the base portion. This is because when the GND (amplifier portion 140) is disposed not on the substrate but on the base portion, a cancellation due to a difference in vector direction between current flowing in the GND (amplifier portion 140) and current flowing in the first helical portion is eliminated.

Example 6

Figure 21:
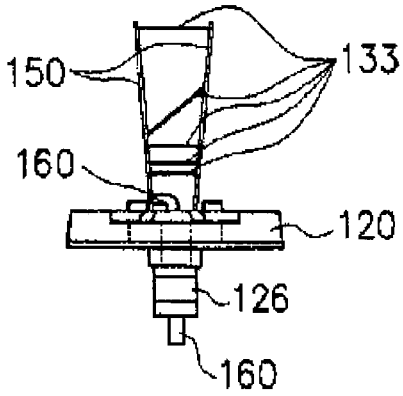
FIG. 21 is a view (front view) illustrating a configuration of an antenna device according to the first embodiment (Example 6) of the present invention.

An antenna device of Example 6 of the present embodiment has substantially the same configuration as that of the antenna device of Example 1 but differs from Example 1 (see FIG. 2(*c*)) in that, as illustrated in FIG. 21, the two substrates are disposed not in parallel to each other but inclined so as to be slightly away from each other toward the top (so as to be close to each other toward the base portion). The main point of the present example is that the second helical portion is disposed so as to be in an open state (so as to be opened outward). Thus, in addition to the above, an arrangement may be adopted in which portions of the substrates corresponding to the first helical portion are disposed in parallel, and only portions of the substrates corresponding to the second helical portion are disposed inclined so as to be slightly away from each other.

Figure 22:
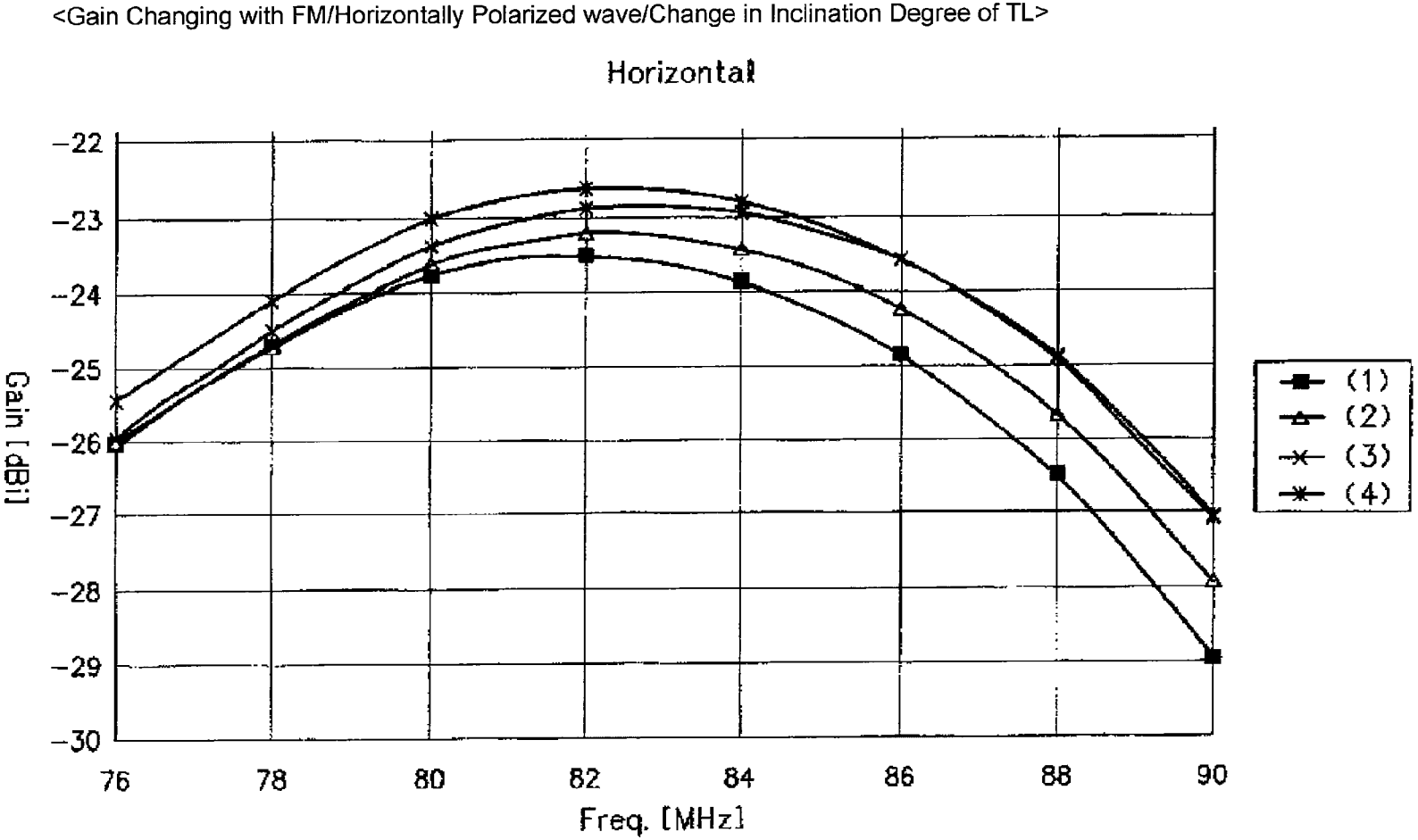
FIG. 22 is a view illustrating antenna characteristics (gain changing with FM/horizontally polarized wave/change in inclination degree of TL) of the antenna device according to the first embodiment (Example 6) of the present invention.
Figure 23:
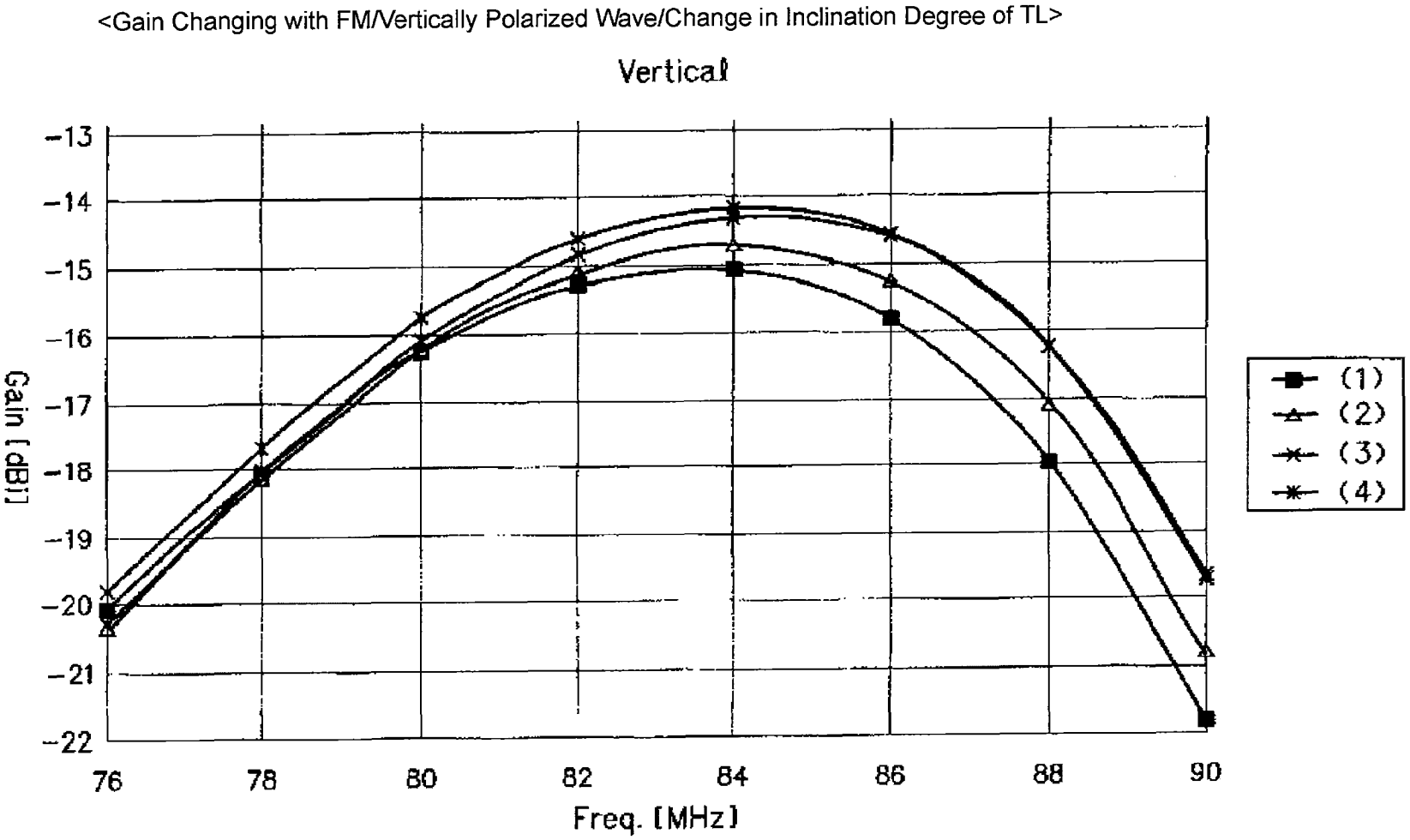
FIG. 23 is a view illustrating antenna characteristics (gain changing with FM/vertically polarized wave/change in inclination degree of TL) of the antenna device according to the first embodiment (Example 6) of the present invention.

FIGS. 22 and 23 each illustrate antenna characteristics obtained in cases where the two substrates on which the second helical portion is formed are disposed inclined so as to be slightly close to each other toward the top (so as to be away from each other toward the base portion), where the two substrates are disposed inclined more so as to be more close to each other toward the top, where the two substrates are disposed in parallel to each other, and where the two substrates are disposed inclined so as to be slightly away from each other toward the top. FIG. 22 represents the characteristics of the horizontally polarized wave, and FIG. 23 represents the characteristics of the vertically polarized wave. In both FIGS. 22 and 23, the case where the two substrates are disposed inclined so as to be slightly close to each other toward the top is represented as "(2)", the case where the two substrates are disposed inclined more so as to be more close to each other toward the top is as "(1)", the case where the two substrates are disposed in parallel to each other is as "(3)", and the case where the two substrates are disposed inclined so as to be slightly away from each other toward the top is as "(4)". As can be seen from FIGS. 22 and 23, for both the horizontally and vertically polarized waves, a gain of the entire antenna is better in the case where two substrates on which the second helical portion is formed are disposed inclined so as to be slightly away to each other toward the top. That is, as described in Example 1, the second helical portion contributes comparatively much to an increase in an amount of radiation, so that when the interval between the two substrates on which the second helical portion is formed is increased, a radiation cancellation amount (when the elements are brought close to each other, facing current vectors easily cancel each other to increase the radiation cancellation amount) from the facing second helical portions is reduced to increase an effective radiation amount (same reason as the one in Example 3).

Example 7

Figure 24:
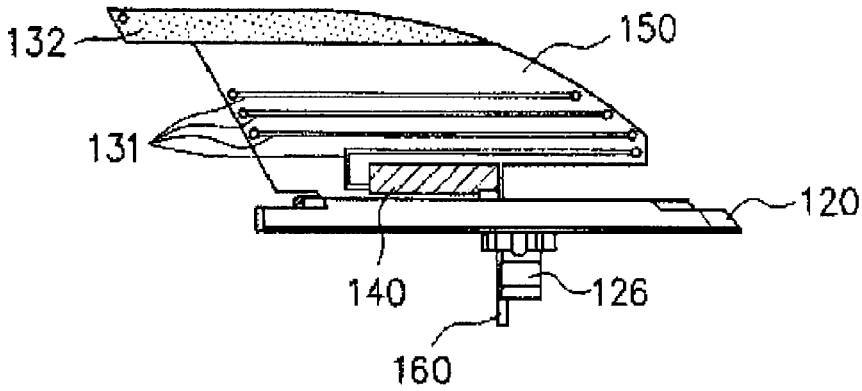
FIG. 24 is a view (side view) illustrating a configuration of an antenna device according to the first embodiment (Example 7) of the present invention.

An antenna device of Example 7 of the present embodiment has substantially the same configuration as that of the antenna device of Example 1 but differs from Example 1 (see FIG. 2(*a*)) in that, as illustrated in FIG. 24, the second helical portion is formed so as to extend and protrude rearward (as viewed in an attachment direction of the antenna device). That is, a part of the second helical portion protrudes toward an end portion of the base portion in the longitudinal direction as viewed from the helical axis direction. The main point of the present example is that, as described as "extended and protruded", not the second helical portion is simply displaced rearward, but a surface area of the second helical portion is increased, and the increased area is made to protrude rearward. However, the present invention is not limited to this, but a configuration in which the horizontal width is kept unchanged may be possible. In this case, the second helical portion is made to protrude rearward so as to be simply offset relative to the first helical portion. That is, in the present example, it is only necessary for the second helical portion to be disposed so as to protrude toward the end portion of the base portion 120 in the longitudinal direction as viewed from the helical axis direction (as viewed from the above).

Figure 25:
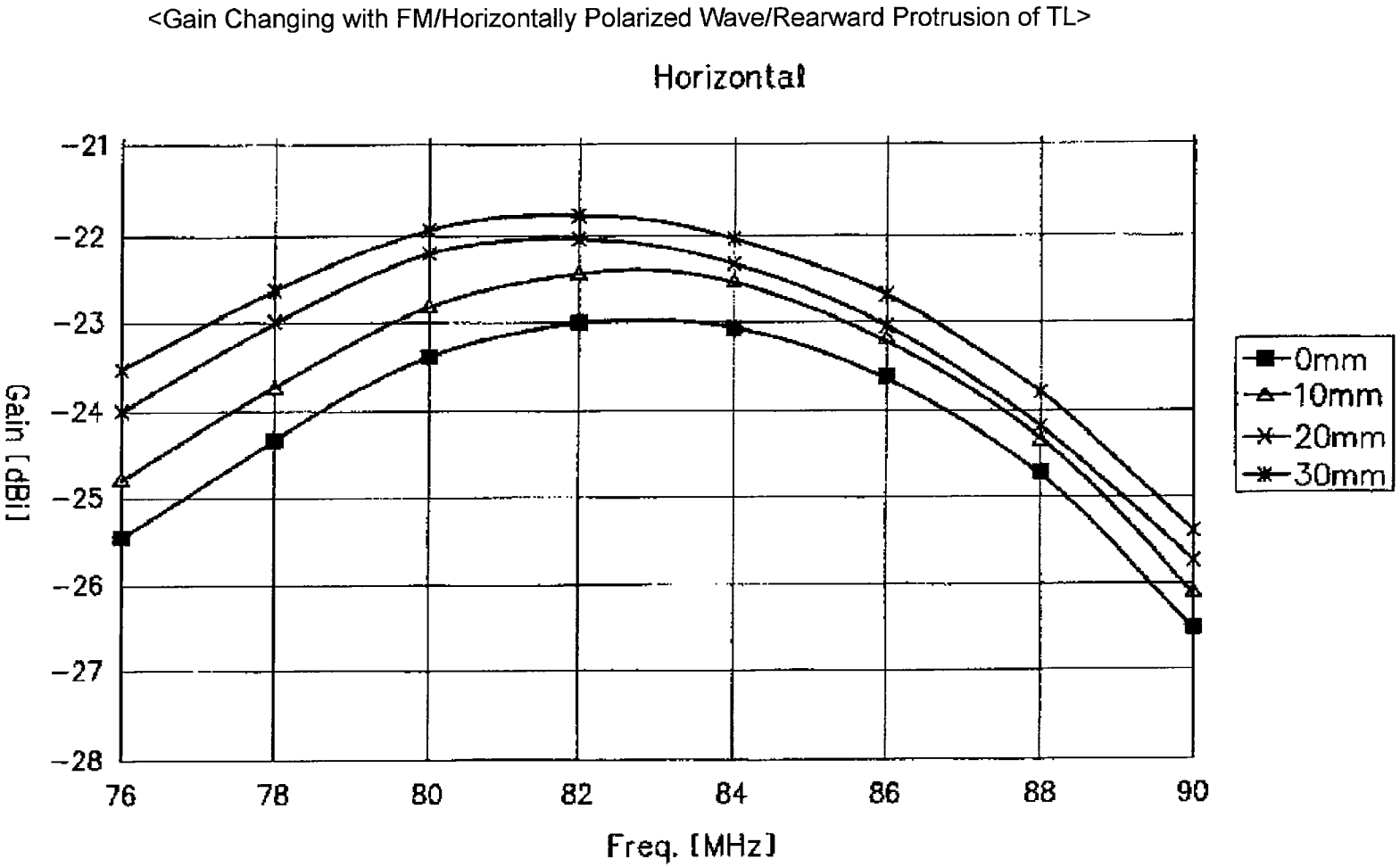
FIG. 25 is a view illustrating antenna characteristics (gain changing with FM/horizontally polarized wave/rearward protrusion of TL) of the antenna device according to the first embodiment (Example 7) of the present invention.
Figure 26:
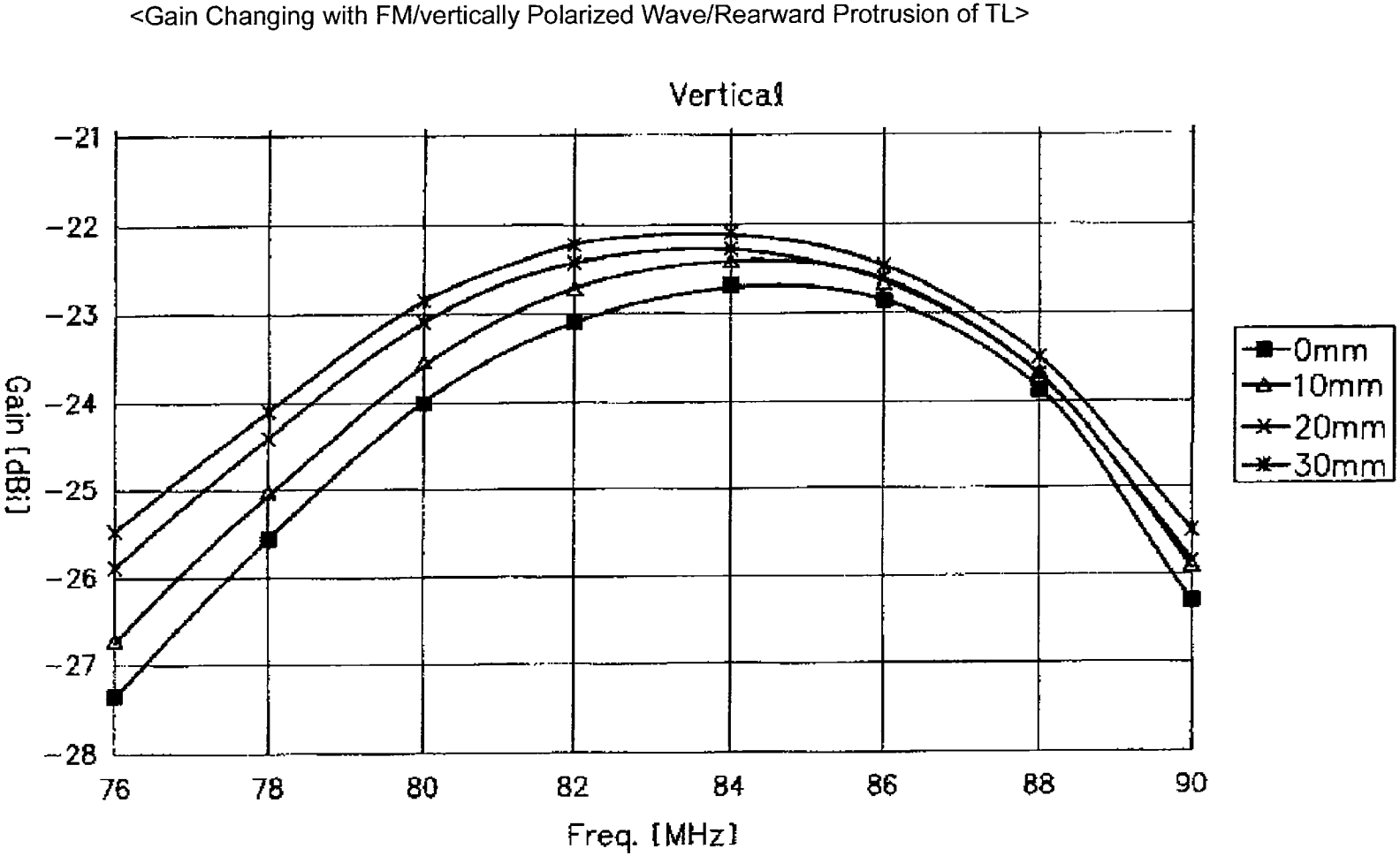
FIG. 26 is a view illustrating antenna characteristics (gain changing with FM/vertically polarized wave/rearward protrusion of TL) of the antenna device according to the first embodiment (Example 7) of the present invention.

FIGS. 25 and 26 each illustrate antenna characteristics obtained in cases where the second helical portion is disposed in the same manner as in Example 1, where the second helical portion is extended rearward by 10 mm as compared with Example 1, where the second helical portion is extended rearward by 20 mm as compared with Example 1, and where second helical portion is extended rearward by 30 mm as compared with Example 1. FIG. 25 represents the characteristics of the horizontally polarized wave, and FIG. 26 represents the characteristics of the vertically polarized wave. In both FIGS. 25 and 26, the case where the second helical portion is disposed in the same manner as in Example 1 is represented as "0 mm". As can be seen from FIGS. 25 and 26, for both the horizontally and vertically polarized waves, a gain of the entire antenna is improved more as the second helical portion is increased in size and enlarged rearward. This is because the second helical portion is closed to a roof edge and thereby radiates more radio waves in the horizontal direction. Further, when the second helical portion is extended rearward and is connected to the first helical portion by the wire 133 passed through the through-hole formed at a rear end of the second helical portion, the length (distance along the helical shape between the connection part with the first helical portion and a tip end of the second helical portion) of the second helical portion is increased, and the line length of the first helical portion can be reduced correspondingly, thereby allowing the first helical portion to be wound more coarsely. The coarser winding of the first helical portion makes a gain of the entire antenna as described in Example 2.

In any of the above-described Examples 1 to 7, the antenna patterns (line pattern 131 and solid pattern 132) may be formed on both surfaces of the substrate. In this case, the patterns may be connected using a conductive member such as a wire (physical connection) and connected without use of the conductive member (electromagnetic connection).

Further, the through-hole may be formed not only at both end portions of the line pattern in the first helical portion and both end portions of the solid pattern in the second helical portion, but also at a plurality of locations ranging inward from the both end portions. With this configuration, the length of the element serving as a helical element can be adjusted finely so as to achieve satisfactory antenna characteristics in a desired frequency band.

Second Embodiment

A second embodiment of the present invention realizes the horizontally long helical element by the first helical portion and second helical portion as in the first embodiment but differs from the first embodiment in that the second helical portion is constituted not by the antenna pattern on the substrate but by a plate-like conductive member (e.g., copper plate). That is, it is enough for the substrate to have an area in which the all the line patterns of the first helical portion can be printed (portion above the tip end of the first helical portion is unnecessary), and the substrate cost can correspondingly be reduced by the amount of the unnecessary portion. Further, in this case, the second helical portion is formed by bending the plate-like conductive member, so that the production thereof is comparatively easily achieved. Thus, as in the first embodiment, it is possible to produce the helical element (horizontally long helical element) of the present invention without taking much trouble and time.

Figure 27:
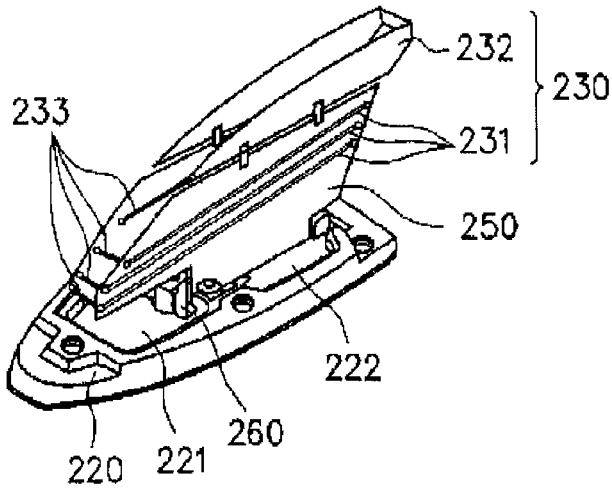
FIG. 27 is a view (perspective view) illustrating a configuration of an antenna device according to a second embodiment of the present invention.

FIG. 27 is a perspective view illustrating a configuration of an antenna device according to the present embodiment. In the present embodiment, a line pattern 231 is formed on a substrate 250, and a plate-like conductive member 232 bent in substantially a U-like shape is fixed, by means of fixing members, to an upper end of the substrate 250. Through-holes (through-holes at substantially facing positions) formed in both end portions of the line pattern 231 are connected by a wire 233 to thereby form a helical shaped first helical portion. On the other hand, the plate-like conductive member 232 functions as a second helical portion constituting the helical shape. A through-hole formed at a position corresponding to a tip end portion (tip end of the helical shape) of the first helical portion is connected by the wire 233 to a through-hole formed on an end portion of the plate-like conductive member 232 on a side that faces the through-hole of the tip end portion of the first helical portion, whereby a helical shape in which the first and second helical portions exist continuously can be formed. That is, a helical element having a horizontally long helical shape as a whole is constituted by the line pattern 231 formed on two facing substrates, plate-like conductive member 232, and wire 233 connecting the line pattern 231 and plate-like conductive member 232.

Examples 2 to 7 of the above-described first embodiment can be practiced as examples in the present embodiment. Examples 2, 4, and 5 are examples concerning the arrangement of the line pattern on the substrate and the arrangement of the amplifier portion and they can be practiced without consideration of the second helical portion constituted by the plate-like conductive member 232. For examples 3 and 6 concerning the arrangement of the two substrates and Example 7 concerning the second helical portion, although it is necessary to consider that the second helical portion is constituted by the plate-like conductive member 232, a size, a length, and a bending angle of the plate-like conductive member can be comparatively easily adjusted, and thus the shape of the plate-like conductive member 232 can be changed as needed without a lot of trouble.

Although the second helical portion is constituted by the plate-like conductive member obtained by processing a single plate in the present embodiment, other members may be used as the conductive member (the same applies to third and fourth embodiments to be described later). The second helical portion may be obtained by forming a pattern in a predetermined area of a base material using conductive substance. For example, the second helical portion may be a solid (or dense pattern such as a fractal pattern or a meander pattern) antenna pattern obtained by printing metal conductive substance (e.g., silver) based paste or ink on a film. Alternatively, the second helical portion may be obtained by molding resin or ceramics into a bent plate and then etching metal conductive substance (e.g., copper) on the plate to form a solid (or dense pattern like a lattice pattern).

Third Embodiment

A third embodiment of the present invention uses two plate-like conductive members having different surface areas (area of an air-contact part for radio wave emission) per unit length to form the first and second helical portions and thereby realizes the horizontally long helical element. A plate-like conductive member having a smaller surface area is used to form the first helical portion, and a plate-like conductive member having a larger surface area is used to form the second helical portion. In the present embodiment, the above-described substrate is not used but an inexpensive conductive member is used to realize the horizontally long helical element, thereby significantly reducing production cost. Further, as described later, the first helical portion can be produced by, for example, punching out a plurality of semicircular shapes from a single plate and folding back the semicircular shapes, and the second helical portion can be produced by, for example, bending a plate-like conductive member. Thus, it can be said that the first and second helical portions can easily be produced. That is, as in the first and second embodiments, it is possible to produce the helical element (horizontally long helical element) of the present invention without taking much trouble and time.

Example 1

Figure 28:
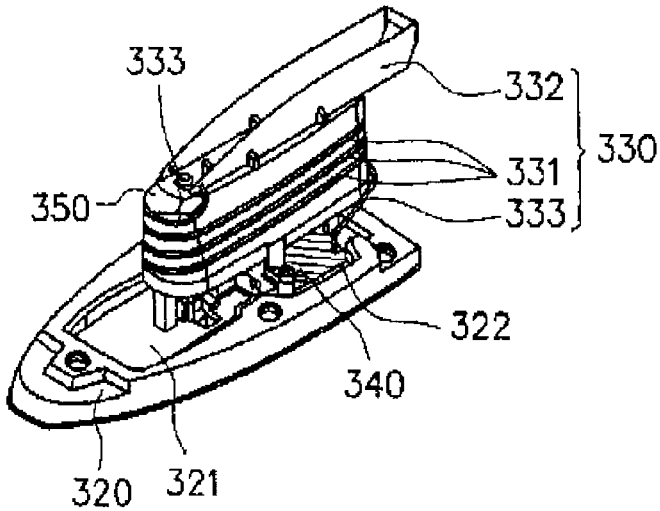
FIGS. 28(*a*) and 28(*b*) are views (perspective view/front view) each illustrating a configuration of an antenna device according to a third embodiment (Example 1) of the present invention.
Figure 28:
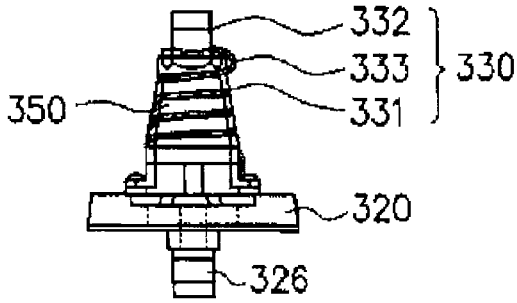

FIGS. 28(*a*) and 28(*b*) are views each illustrating a configuration of an antenna device according to Example 1 of the present embodiment. FIG. 28(*a*) is a perspective view, and FIG. 28(*b*) is a front view. The antenna device according to the present example includes an antenna portion 330 that emits and receives radio waves, a base portion 320 on which the antenna portion 330 is mounted, and an antenna support portion 350 installed on the base portion 320 so as to support the antenna portion 300. A patch antenna installation space 321 and an amplifier substrate accommodating space 322 are formed on a surface of the base portion 320 opposite to a vehicle attachment surface (installation surface of an antenna attachment portion 326) thereof, and an amplifier portion 340 is provided on the amplifier substrate accommodating space 322. This is because that it is considered that the substrate having an installation space for the amplifier portion is not used unlike the first and second embodiments and that it is preferable to obtain better antenna characteristics.

In the present embodiment, the antenna portion 330 includes a sheet metal coil 331 (plate-like conductive member having a smaller surface area), a plate-like conductive member 332 (having a larger surface area), and a conductor 333. The sheet metal coil 331 has a helical shape formed by winding a plate-like (strip-shaped) conductive member having a predetermined width around side surfaces of the antenna support portion 350 (winding the conductive member in such a direction that a surface of the conductive member having the predetermined width faces the side surfaces of the antenna support portion 350 (in a vertically standing state relative to the installation surface) and supported by the antenna support portion 350. The predetermined width refers to a width in which the helical shape can be formed at an interval equivalent to the interval between the line patterns used in the first and second embodiments. The plate-like conductive member 332, which is obtained by bending a shape punched out from a single plate into substantially a U-like shape, is attached and fixed to a top surface (surface perpendicular to the side surface and on the opposite side to the base portion 320) of the antenna support portion 350 to be positioned above the sheet metal coil 331. The conductor 333 is generally used as an antenna element and connects the sheet metal coil 331 with the amplifier portion and plate-like conductive member 332, for example, through soldering.

The helical shaped first helical portion is constituted by the sheet metal coil 331 and conductor 333 connected to the sheet metal coil 331, the second helical portion constituting a part of the helical shape is constituted by the plate-like conductive member 332, and the first and second helical portions are connected to each other to thereby forming a helical shape in which the first and second helical portions are continued. That is, a helical element having a horizontally long helical shape as a whole is constituted by the sheet metal coil 331, plate-like conductive member 332, and conductor 333 connecting the sheet metal coil 331 and plate-like conductive member 332.

A supplementary description will be made of production of the sheet metal coil 331. The sheet metal coil 331 can be produced by punching out a single plate (conductive member) in a repeated pattern obtained by successively arranging semicircles (half of an ellipse) such that upward curving semicircles and downward curving semicircles obtained by rotating the upward curving semicircles at 180° alternately appear and that end portions of the semicircles are connected and by folding back the punched out pattern flutteringly so as to obtain an oblong helical shape. Alternatively, the plurality of punched out semicircular members may be connected in a stacked manner. With these methods, a strip-shaped helical element can be produced mechanically, allowing mass production to be achieved at low cost, which is advantageous in terms of cost competition.

Example 2

Figure 29:
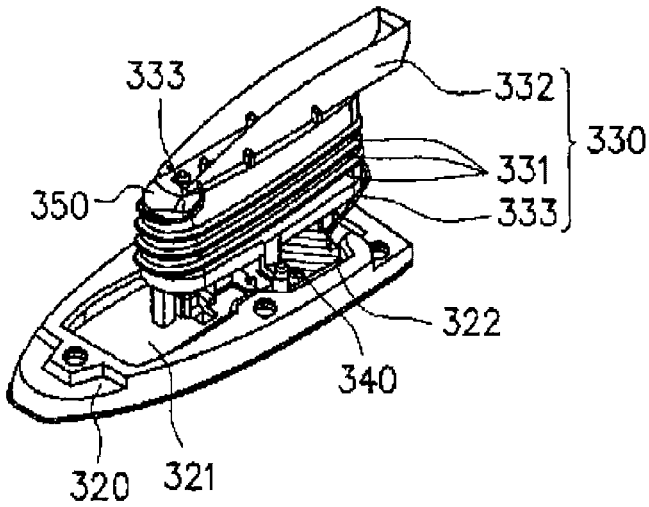
FIGS. 29(*a*) and 29(*b*) are views (perspective view/front view) each illustrating a configuration of an antenna device according to the third embodiment (Example 2) of the present invention.
Figure 29:
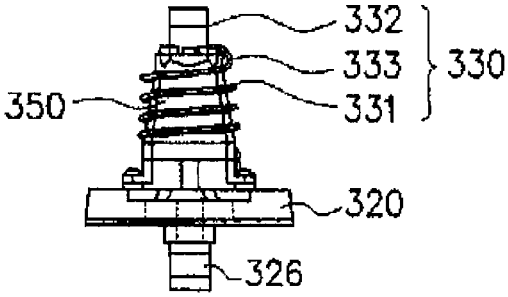

FIGS. 29(*a*) and 29(*b*) are views each illustrating a configuration of an antenna device according to Example 2 of the present embodiment. FIG. 29(*a*) is a perspective view, and FIG. 29(*b*) is a front view. The antenna device of the present example has substantially the same configuration as Example 1 (FIGS. 28(*a*) and 28(*b*)) but differs from Example 1 (sheet metal coil 331 is wound in a vertically flat state) in that the sheet metal coil 331 is wound in a horizontally flat state with respect to the installation surface to form a horizontally long helical shape. That is, as illustrated in FIG. 29(*b*), the sheet metal coil 331 is wounded around the side surfaces of the antenna support portion 350 in such a manner that a surface of the sheet metal coil 331 having a predetermined width is perpendicular to the side surfaces of the antenna support portion 350.

As compared with the case of Example 1 (vertically arranged sheet metal coil), production of the horizontally arranged sheet metal coil of the present example becomes slight difficult. However, by disposing the surface having a predetermined width in a horizontally flat state, the helical pitch can be made larger by the predetermined width. This corresponds to an increase in the interval between the line patterns in the first and second embodiments and increases a gain of the entire antenna as compared with Example 1.

Example 3

Figure 30:
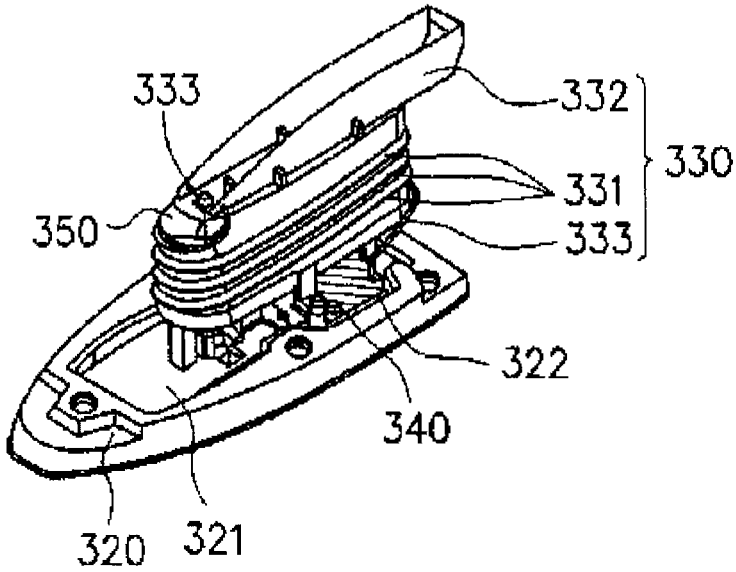
FIGS. 30(*a*) and 30(*b*) are views (perspective view/front view) each illustrating a configuration of an antenna device according to the third embodiment (Example 3) of the present invention.
Figure 30:
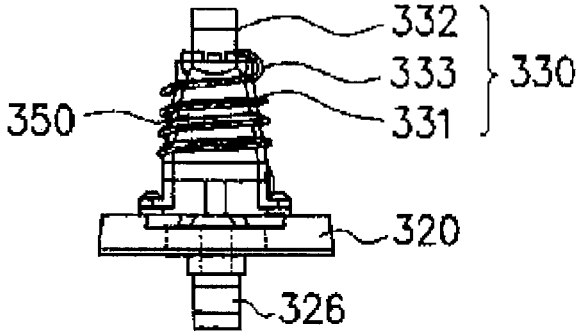

FIGS. 30(*a*) and 30(*b*) are views each illustrating a configuration of an antenna device according to Example 3 of the present embodiment. FIG. 30(*a*) is a perspective view, and FIG. 30(*b*) is a front view. The antenna device of the present example has substantially the same configuration as Example 1 (FIGS. 28 (*a*) and 28(*b*)) and Example 2 (FIGS. 29(*a*) and 29(*b*)) but differs from Examples 1 and 2 in a winding state of the sheet metal coil 331 with respect to the installation surface. The present example is intermediate between Examples 1 and 2, in which the sheet metal coil 331 is wounded in an obliquely inclined state with respect to the installation surface to form the horizontally long helical shape. That is, as illustrated in FIG. 30(*b*), the surface of the sheet metal coil 331 having a predetermined width is wounded around the side surfaces of the antenna support portion 350 in an inclined state at a predetermined angle with respect to the side surfaces of thereof.

Production of the inclined arranged sheet metal coil of the present example can be made by utilizing the same production method as that for Example 1 (vertically arranged sheet metal coil) (before folding processing, a process of twisting the punched out repeated pattern is added so that the pattern is angled as a result of the folding processing) and is achieved substantially as easily as in Example 1. Further, by inclining the surface having a predetermined width, the helical pitch can be made larger by the predetermined width. This increases a gain of the entire antenna as compared with Example 1.

In the present embodiment, the second helical portion may be formed using a line conductive member, not a plate-like conductive member. For example, a wire can be taken as an example of the line conductive member. The wire may be a commonly used stiff one or a covered (or uncovered) electric one having high flexibility to be used as a power line. Further, a groove for positioning may be formed in the side surfaces of the support member. This allows the first helical portion to be produced correctly and quickly.

Fourth Embodiment

In a fourth embodiment of the present invention, a film antenna is used to form the first helical portion, a plate-like conductive member having a larger surface area (area of an air-contact part for radio wave emission) than the first helical portion is used to form the second helical portion, and thereby the horizontally long helical shaped element is realized. The present embodiment differs from the third embodiment in that a film antenna is used for the first helical portion. The film antenna is wound around and bonded to the side surfaces of the support member and is then connected to the second helical portion, whereby the helical element can be produced. This configuration achieves a significant reduction in production cost and makes production simpler.

The first helical portion is a line antenna pattern which is formed using a typical film antenna and obtained by printing metal conductive substance (e.g., silver) based paste or ink on a film. The antenna pattern may be realized by a single helical line or by a plurality of lines. In the latter case, a connection part is formed on the front side (patch antenna installation space side (see FIG. 28(*a*)) of the support member, and a single (corresponding to one round in the longitudinal direction) pattern is bonded such that both end portions thereof are connected to the connection part. This processing is performed for all the lines and whereby the helical shape can be formed. In either case, the positioning groove may be formed in the support member side surfaces. This allows the first helical portion to be produced correctly and quickly.

Examples 2 to 4, 6, and 7 of the above-described first embodiment can be practiced as examples in the third and fourth embodiment. Examples 2 to 4 are examples concerning the arrangement of the line pattern on the substrate, which can be practiced in the third embodiment by changing a shape of the metal sheet coil and can be practiced in the fourth embodiment by changing a shape of the film antenna (printed element part). For Example 3, when applied to the present embodiment, a size of the antenna support portion 350 is increased (e.g., extended in the longitudinal direction), and a shape of the metal sheet coil 331 or film antenna is correspondingly changed (that is, an increase in the interval between the substrates is made for the purpose of increasing the diameter of the helical shape, and this purpose is achieved by winding more largely the metal sheet coil 331 in the third embodiment and by winding more largely the film antenna in the fourth embodiment). Examples 6 and 7 are examples concerning the second helical portion and they can be practiced by adjusting a size, a length, and a bending angle of the plate-like conductive member. This adjustment can comparatively easily be made, thereby comparatively easily changing the shape of the plate-like conductive member 332 so as to be matched to the individual examples.

Fifth Embodiment

In a fifth embodiment of the present invention, the second helical portion is constituted by a plurality of windings. That is, in the embodiments described above, the second helical portion is constituted by a single winding; on the other hand, in the present embodiment, the second helical portion divided into a plurality of winding parts is wound so as to form a helical shape. This can reduce an electrical length of the first helical portion and increases an electrical length of the second helical portion which is away from the base portion. As a result, it is possible to reduce interference with the ground to improve the antenna gain.

Example 1

Figure 31:
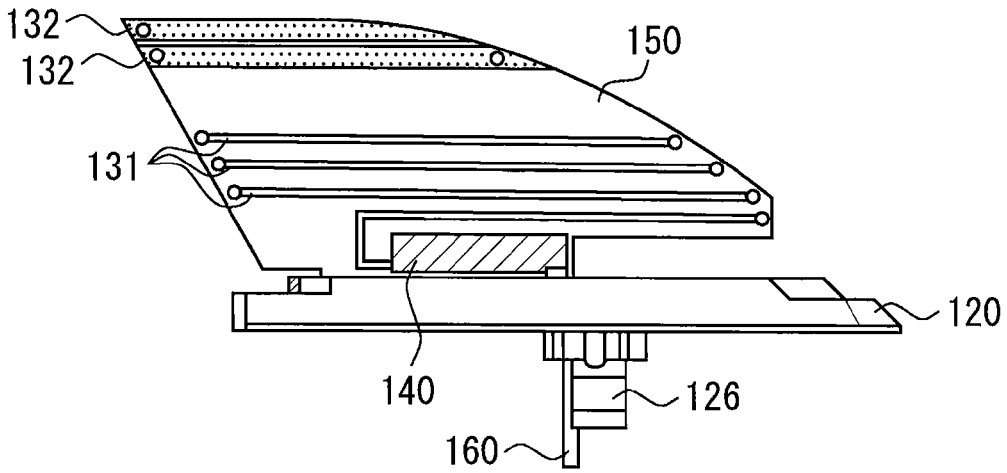
FIG. 31 is a view (side view) illustrating a configuration of an antenna device according to a fifth embodiment (Example 1) of the present invention.

FIG. 31 is a side view illustrating a configuration of an antenna device according to Example 1 of the present embodiment. A configuration of the antenna device according to Example 1 of the present embodiment is substantially the same as that of Example 1 (FIG. 2) of the first embodiment but differs therefrom in that the solid pattern 132 constituting the second helical portion is divided into two winding parts. That is, the second helical portion is wound in a plurality of windings with a configuration in which the surface area per unit length of the second helical portion is larger than that of the first helical portion kept unchanged. For example, a slit is cut into the solid pattern formed on the substrate 150 to divide the solid pattern into upper and lower parts, and the both parts are wound in a helical shape using the wire 133. Alternatively, a constitution may be possible in which the plate-like conductive member used in the second embodiment may be bent so as to wound in a plurality of windings.

Example 2

Figure 32:
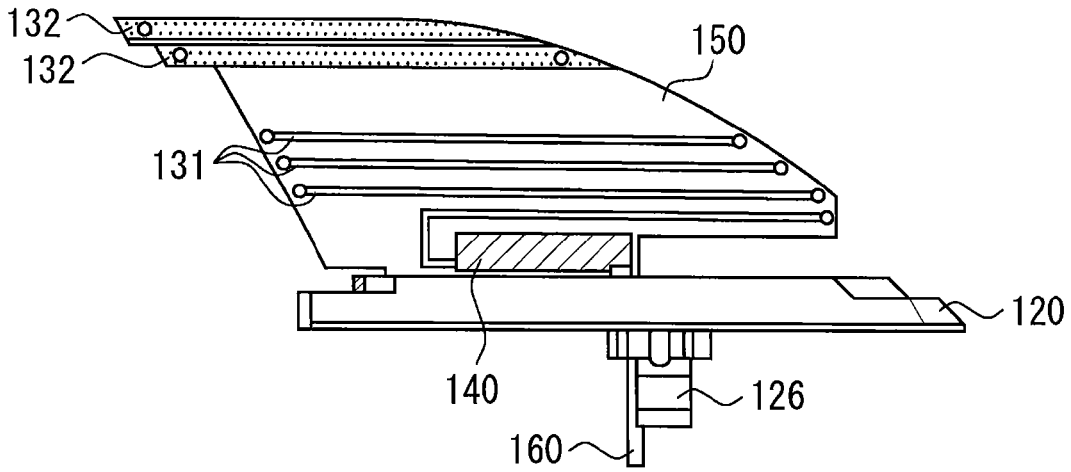
FIG. 32 is a view (side view) illustrating a configuration of an antenna device according to the fifth embodiment (Example 2) of the present invention.

FIG. 32 is a side view illustrating a configuration of an antenna device according to Example 2 of the present embodiment. A configuration of the antenna device according to Example 2 of the present embodiment is substantially the same as that of Example 1 (FIG. 31) of the present embodiment but differs therefrom in that the second helical portion is extended such that upper stage of the helical portion protrudes rearward (as viewed in the attachment direction of the antenna device) more. As a result, the same effect as in Example 7 (FIG. 24) of the first embodiment can be obtained.

Examples 1 and 2 of the present embodiment can be applied to any of the above first to fourth embodiments.

Sixth Embodiment

Figure 33:
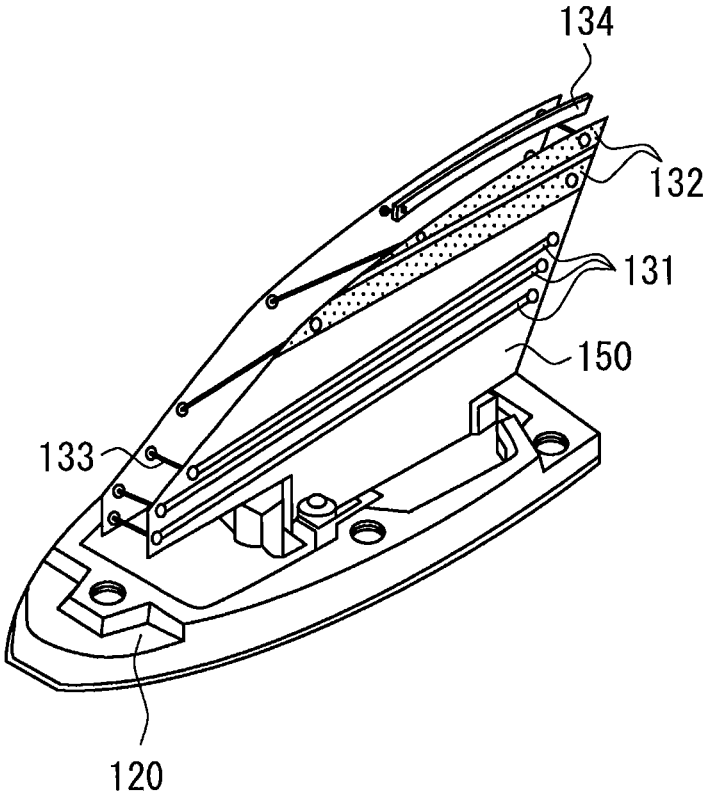
FIG. 33 is a view (perspective view) illustrating a configuration of an antenna device according to a sixth embodiment of the present invention.

In a sixth embodiment of the present invention, an additional antenna element is added to the antenna portion, more specifically, to a tip end of the second helical portion so as to make an effective use of a limited space in a top end portion of the shark-fin shape. FIG. 33 is a perspective view illustrating a configuration of an antenna device according to the present embodiment. A configuration of the antenna device according to the present embodiment is substantially the same as that of fifth embodiment but differs therefrom in that the antenna portion 130 further has an antenna element 134. The antenna element 134 is connected to the tip end of the second helical portion constituted by the solid pattern 132. The antenna element 134 is disposed along the top end portion of the second helical portion as viewed in the short-side direction perpendicular to the helical axis direction. Further, the antenna element 134 is disposed so as to pass through the helical axis as viewed in the longitudinal direction perpendicular to the helical axis direction, that is, so as to traverse a center of the second helical portion in the longitudinal direction. However, the antenna element 134 need not always be disposed so as to traverse the center of the second helical portion in the longitudinal direction but may be disposed so as to traverse a portion displaced from the center. The antenna element 134 in this embodiment is a plate blade-shaped element disposed such that a plate surface thereof faces a side surface of the second helical portion. Forming the antenna element 134 into such a configuration allows the antenna element 134 to be fitted tightly into a narrow space in the top end portion of the shark-fin shaped antenna cover. The shape of the antenna element 134 is not limited to the blade shape, but may be a line shape. Although the configuration like the fifth embodiment in which the second helical portion is wounded in a plurality of windings is illustrated in FIG. 33, the present invention is not limited to this, but the single-wound second helical portion like the first embodiment may be applied to the present embodiment. The antenna element described in the sixth embodiment can be applied to any of the above first to fifth embodiment.

The above embodiments and examples are merely exemplary of preferred embodiments of the present invention and do not limit the scope of the present invention. Thus, various modifications may be made without departing from the scope of the present invention.

EXPLANATION OF SYMBOLS

100: Antenna device
110: Antenna cover
120, 220, 320: base portion
121, 221, 321: Patch antenna accommodating space
122, 222, 322: Amplifier substrate accommodating space
126, 326: Antenna attachment portion
130, 230, 330: Antenna portion
131, 231: Line pattern
132: Solid pattern
133, 233: Wire
134: Antenna element
140, 340: Amplifier portion
150, 250: Substrate
160, 260: Coaxial cable
232, 332: Plate-like conductive member
331: Metal sheet coil
350: Antenna support portion

What is claimed is:

1. A low-profile antenna device for use in a vehicle characterized by comprising:

a base portion fixed to the vehicle; and an antenna portion supported by the base portion and including a first helical portion disposed on a near side to the base portion and a second helical portion disposed on a far side from the base portion, the second helical portion having a larger surface area per unit length than that of the first helical portion.

2. The antenna device according to claim 1, in which the antenna portion has a portion having a length in a longitudinal direction that passes perpendicularly through a helical axis larger than a length thereof in the helical axis direction.

3. The antenna device according to claim 1, in which a frequency of the first helical portion is adjusted to a resonance frequency of a higher band when the antenna portion is designed as a two-wave adaptive antenna.

4. The antenna device according to claim 1, in which the second helical portion is disposed so as not to cover the first helical portion as viewed in a direction passing perpendicularly through a helical axis.

5. The antenna device according to claim 1, in which a horizontal width of the second helical portion as viewed in a short-side direction perpendicular to the helical axis direction is equal to or smaller than a horizontal width of the first helical portion.

6. The antenna device according to claim 1, in which the second helical portion is disposed such that a part thereof protrudes toward an end portion of a longitudinal direction of the base portion as viewed in the helical axis direction.

7. The antenna device according to claim 1, in which the first helical portion includes a line antenna pattern formed at least on opposite surfaces to facing surfaces of two substrates supported by the base portion.

8. The antenna device according to claim 7, in which the second helical portion includes an antenna pattern formed in a predetermined area including an end portion on a far side from the base portion and at least on opposite surfaces to facing surfaces of the two substrates.

9. The antenna device according to claim 1, in which the second helical portion is formed using a conductive member obtained by bending a single plate.

10. The antenna device according to claim 9, in which the first helical portion is formed using one of a line antenna pattern formed on a film-like substrate, a wire-shaped conductive member, a plate-like conductive member obtained by punching, and a line antenna pattern formed at least on opposite surfaces to facing surfaces of the two substrates supported by the base portion.

11. The antenna device according to claim 1, in which the second helical portion is wounded in a plurality of winding numbers.

12. The antenna device according to claim 11, in which the second helical portion is disposed such that a winding part far side from the first helical portion protrudes more toward a longitudinal one end side of the base portion than a winding part near side to the first helical portion as viewed in the helical axis direction.

13. The antenna device according to claim 1, in which the antenna portion further includes an antenna element connected to a tip end of the second helical portion and disposed along a top end portion of the second helical portion as viewed in the short-side direction perpendicular to the helical axis direction.

14. The antenna device according to claim 1, in which the base portion is made of resin.

* * * * *

UNITED STATES PATENT AND TRADEMARK OFFICE

CERTIFICATE OF CORRECTION

PATENT NO. : 8,816,917 B2
APPLICATION NO. : 13/979371
DATED : August 26, 2014
INVENTOR(S) : Mikio Ueno et al.

It is certified that error appears in the above-identified patent and that said Letters Patent is hereby corrected as shown below:

On the Title Page

Page 2, References Cited, Second Column, FOREIGN PATENT DOCUMENTS, Please add --JP 2004-153502 5/2004--

Signed and Sealed this
Twenty-fifth Day of August, 2015

Michelle K. Lee

Michelle K. Lee
*Director of the United States Patent and Trademark Office*